US010457058B2

(12) United States Patent
Akahane

(10) Patent No.: US 10,457,058 B2
(45) Date of Patent: Oct. 29, 2019

(54) LIQUID SUPPLY VALVE, FLOW CHANNEL SYSTEM, AND METHOD OF USING LIQUID SUPPLY VALVE

(71) Applicant: SEIKO EPSON CORPORATION, Tokyo (JP)

(72) Inventor: Fujio Akahane, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 84 days.

(21) Appl. No.: 15/598,019

(22) Filed: May 17, 2017

(65) Prior Publication Data

US 2017/0341408 A1 Nov. 30, 2017

(30) Foreign Application Priority Data

May 26, 2016 (JP) ..... 2016-105093

(51) Int. Cl.
*B41J 2/175* (2006.01)

(52) U.S. Cl.
CPC ..... *B41J 2/17596* (2013.01)

(58) Field of Classification Search
CPC ..... B41J 2/18
See application file for complete search history.

(56) References Cited

U.S. PATENT DOCUMENTS 5,903,293 A * 5/1999 Nikkels ..... B41J 2/17506 347/85
8,425,020 B2 * 4/2013 Borra ..... B41J 2/175 347/85
2005/0200666 A1 * 9/2005 Iwasaki ..... B41J 2/17509 347/84
2012/0182363 A1 7/2012 Watanabe

FOREIGN PATENT DOCUMENTS

| | | |
|---|---|---|
| JP | 05-338203 | 12/1993 |
| JP | 2005-212175 | 8/2005 |
| JP | 2005-254809 | 9/2005 |
| JP | 2012-148411 | 8/2012 |

* cited by examiner

*Primary Examiner* — Julian D Huffman
*Assistant Examiner* — Michael T Konczal
(74) *Attorney, Agent, or Firm* — Workman Nydegger

(57) ABSTRACT

A valve for connecting a second-flow-channel, which supplies a liquid to a liquid-ejecting-head, with a first-flow-channel of the liquid-ejecting-head which ejects the liquid, includes a valve-casing, a first-connector that detachably connects the first-flow-channel, a second-connector that connects the second-flow-channel, a first-connection-port that communicates with the first-flow-channel which is connected with the first-connector, a second-connector that communicates with the second-flow-channel which is connected with the second-connector, and a valve-body in which a connecting-flow-channel is formed for connecting the first-connection-port and the second-connection-port, and that is moved inside the valve-casing to switch a connection state between the first-connection-port and the second-connection-port among a plurality of states. The plurality of states include a first state in which the first-connection-port and the second-connection-port communicate with each other via the connecting-flow-channel, and a second state in which the first-connection-port and the second-connection-port are disconnected.

6 Claims, 19 Drawing Sheets

LIQUID SUPPLY VALVE, FLOW CHANNEL SYSTEM, AND METHOD OF USING LIQUID SUPPLY VALVE

The entire disclosure of Japanese Patent Application No: 2016-105093, filed May 26, 2016 is expressly incorporated by reference herein in its entirety.

BACKGROUND

1. Technical Field

The invention relates to a technique of circulating a liquid, such as ink.

2. Related Art

In a liquid ejecting apparatus which ejects a liquid, such as ink, from nozzles of liquid ejecting heads, flow channels are formed for circulating the liquid from a liquid container (a cartridge) to each nozzle of the liquid ejecting head. For example, in JP-A-2012-148411, a flow channel (a liquid supply pipe) which supplies a liquid from a liquid container is connected with a liquid introduction pipe of a liquid ejecting head to form a liquid flow path.

However, in the configuration described in JP-A-2012-148411, since the flow channel which supplies the liquid from the liquid container is directly attached to and detached from the liquid introduction pipe of the liquid ejecting head, there is a possibility that ink or other liquid may drip during the attachment and detachment.

SUMMARY

An advantage of some aspects of the invention is that dripping of a liquid is prevented during attachment and detachment of a flow channel, which supplies a liquid, to and from a liquid ejecting head.

According to an aspect of the invention, a liquid supply valve for connecting a second flow channel, which supplies a liquid to a liquid ejecting head, with a first flow channel of the liquid ejecting head which ejects the liquid, includes a valve casing, a first connecting portion that detachably connects the first flow channel, a second connecting portion that connects the second flow channel, a first connection port that communicates with the first flow channel which is connected with the first connecting portion, a second connection port that communicates with the second flow channel which is connected with the second connecting portion, and a valve body in which a connecting flow channel is formed for connecting the first connection port and the second connection port, and that is moved inside the valve casing to switch a connection state between the first connection port and the second connection port among a plurality of states. The plurality of states include a first state in which the first connection port and the second connection port communicate with each other via the connecting flow channel, and a second state in which the first connection port and the second connection port are disconnected. With this configuration, the first connection port and the second connection port may be disconnected by moving the valve body to switch the connection state to the second state. Therefore, by detaching and attaching the liquid supply valve, to which the second flow channel is connected, from and to the first flow channel of the liquid ejecting head after switching to the second state, dripping of a liquid during attachment and detachment may be prevented.

In this case, the valve casing includes an air release port for releasing the first connection port to air, the plurality of states include a third state in which the first connection port and the second connection port are disconnected, and the first connection port and the air release port communicate with each other, and in the first state and the second state, the first connection port and the air release port are disconnected. With this configuration, a liquid remaining in the connecting flow channel communicating with the first connection port may be discharged via the liquid ejecting head by switching the connection state of the valve body to the third state before detaching the liquid supply valve from the first flow channel of the liquid ejecting head. Therefore, dripping of a liquid remaining in the connecting flow channel may be prevented when the liquid supply valve is detached from the liquid ejecting head. Further, if the connection state of the valve body is switched to the third state before detaching the valve casing from the liquid ejecting head, the liquid in the liquid ejecting head may also be discharged together with the liquid remaining in the connecting flow channel.

In this case, the first state and the second state may be switched not via the third state. With this configuration, since the valve body may be switched between the first state and the second state not via the third state, the first flow channel and the second flow channel may be disconnected or communicate with each other without releasing the liquid ejecting head to air. Accordingly, when the liquid supply valve is attached to the liquid ejecting head, for example, by sucking the inside of the liquid ejecting head while keeping the first flow channel and the second flow channel disconnected in the second state, and then making the connection state of the valve body be returned to the first state and making the first flow channel and the second flow channel communicate with each other, the liquid may be flowed into the liquid ejecting head at once (head chalk sucking). Therefore, air bubbles in the connecting flow channel may be discharged easily.

In this case, the connecting flow channel includes a first connecting flow channel for connecting the first connection port and the second connection port, and a second connecting flow channel for connecting the first connection port and the air release port. In the third state, the air release port communicates with an end portion of the second connecting flow channel on the side opposite to an end portion connected with the first connection port. With this configuration, in the third state, since the air release port communicates with the end portion of the second connecting flow channel on the side opposite to the end portion connected with the first connection port, dripping of a liquid from the air release port may be prevented by making the liquid remaining in the second connecting flow channel flow toward the first connection port in the third state.

In this case, the first connecting flow channel and the air release port do not communicate with each other. With this configuration, since the first connecting flow channel and the air release port do not communicate with each other, the liquid in the first connecting flow channel does not drip from the air release port.

In this case, a filter is provided in the air release port. With this configuration, the filter may prevent ingress of foreign materials into the valve casing through the air release port.

In this case, the first connecting portion is detachably connected with a downstream side channel member constituted by a non-flexible member and forming the first flow channel, and the second connecting portion is fixed to an upstream side channel member constituted by a flexible member and forming the second flow channel. With this configuration, since the second flow channel is formed of a flexible member even if the first flow channel is formed of a non-flexible member, the liquid ejecting head is easily moved in the state where the liquid supply valve is attached thereto.

In this case, a groove is provided in the second connecting portion on a contact surface with the upstream side channel member. With this configuration, since a groove is provided in the second connecting portion on a contact surface with the upstream side channel member, a friction coefficient between the second connecting portion and the upstream side channel member increases and, therefore, the upstream side channel member becomes less easily removed from the second connecting portion.

In this case, the valve body is moved in a direction to cross the connecting flow channel during switching of a plurality of states. With this configuration, since occurrence of pressure variation in the connecting flow channel upon switching of a plurality of states may be reduced, pushing out or pulling back of the liquid with respect to the liquid ejecting head may be reduced.

In this case, the liquid ejecting head includes a valve mechanism that keeps pressure constant in the first flow channel. With this configuration, if a valve mechanism (for example, a self-sealing valve) for keeping pressure constant in the first flow channel is provided in the liquid ejecting head, since the first connecting portion is connected via the valve mechanism, the valve mechanism is disposed downstream of the liquid supply valve. Since the liquid supply valve may be detached from the liquid ejecting head while the pressure in the first flow channel is kept constant by the valve mechanism, an effect of preventing dripping of a liquid may be improved as compared with a case where the valve mechanism is not disposed downstream of the liquid supply valve.

In this case, a locking mechanism that sets a connection between the first connecting portion of the valve casing and the first flow channel of the liquid ejecting head to a locked state or an unlocked state. With this configuration, in the first state, for example, removal of the first flow channel of the liquid ejecting head from the first connecting portion may be prevented by setting the locking mechanism to the locked state. In the second state, the first connecting portion may be detached from the first flow channel of the liquid ejecting head by setting the locking mechanism to the unlocked state.

In this case, the valve casing includes a regulating member that regulates a movement of the valve body to keep at least one of the plurality of states. With this configuration, since the movement of the valve body is regulated by the regulating member, the valve body is easily switched to that state.

In this case, the valve body is movable between positions corresponding to the plurality of states until being regulated by the regulating member. With this configuration, since the valve body is movable between positions corresponding to the plurality of states until being regulated by the regulating member, variation in tolerance caused by the position of the valve body may be absorbed in the plurality of states.

In this case, a diameter of the connecting flow channel of a portion at which the connecting flow channel is connected with the first connection port is equal to or greater than a diameter of the first connection port, a diameter of the connecting flow channel of a portion at which the connecting flow channel is connected with the second connection port is equal to or smaller than a diameter of the second connection port, and the diameter of the first connection port is equal to or smaller than the diameter of the second connection port. With this configuration, if one of the diameters of the connection ports of the connecting flow channel is larger than the other, the connecting flow channel may be connected without requiring strict alignment. If the diameter of the connecting flow channel on the upstream side is larger than the diameter on the downstream side, trapping of air bubbles moved by buoyancy at a diameter-changing portion may be prevented.

In this case, the valve casing includes a lever that moves the valve body to positions corresponding to the plurality of states. With this configuration, the valve body may easily be moved to positions corresponding to the a plurality of states by the lever.

In this case, connection states are switched at once regarding a plurality of types of liquids. With this configuration, since connection states are switched at once regarding a plurality of types of liquids, time and effort for the operation may be saved as compared with a case where connection states are switched separately regarding a plurality of types of liquids.

According to another aspect of the invention, a flow channel system includes a liquid supply valve that connects a second flow channel, which supplies a liquid to a liquid ejecting head, with a first flow channel of the liquid ejecting head which ejects the liquid, an upstream side channel member that includes the second flow channel connected with the liquid supply valve on an upstream side of the liquid supply valve, and a downstream side channel member that includes the first flow channel connected with the liquid supply valve on a downstream side of the liquid supply valve. The liquid supply valve includes a valve casing, a first connecting portion that connects the first flow channel, a second connecting portion that connects the second flow channel, a first connection port that communicates with the first flow channel which is connected with the first connecting portion, a second connection port that communicates with the second flow channel which is connected with the second connecting portion, and a valve body in which a connecting flow channel is formed for connecting the first connection port and the second connection port, and that is moved inside the valve casing to switch a connection state between the first connection port and the second connection port among a plurality of states. The plurality of states include a first state in which the first connection port and the second connection port communicate with each other via the connecting flow channel, and a second state in which the first connection port and the second connection port are disconnected. Fixation between the downstream side channel member and the liquid supply valve is more easily released than fixation between the upstream side channel member and the liquid supply valve. With this configuration, since the downstream side channel member is fixed to be more easily removed than the upstream side channel member is, the liquid supply valve may easily be attached to and detached from the downstream side channel member in a state where the liquid supply valve is fixed to the upstream side channel member. According to this aspect, since the first connection port of the liquid ejecting head and the second connection port may be disconnected by switching the connection state of the valve body from the first state to the second state, dripping of a liquid may be prevented when the liquid supply valve to which the second connection port is fixed is attached to and detached from the first flow channel of the liquid ejecting head.

According to further aspect of the invention, provided is a method of using a liquid supply valve for connecting a second flow channel, which supplies a liquid to a liquid ejecting head, with a first flow channel of the liquid ejecting head which includes a nozzle for ejecting the liquid. The liquid supply valve includes a valve casing, a first connecting portion that connects the first flow channel, a second connecting portion that connects the second flow channel, a first connection port that communicates with the first flow channel which is connected with the first connecting portion, a second connection port that communicates with the second flow channel which is connected with the second connecting portion, and a valve body in which a connecting flow channel is formed for connecting the first connection port and the second connection port, and that is moved inside the valve casing to switch a connection state between the first connection port and the second connection port among a plurality of states, and an air release port that releases the first connection port to air. The plurality of states include a first state in which the first connection port and the second connection port communicate with each other via the connecting flow channel, and the first connection port and the air release port are disconnected, and a second state in which the first connection port and the second connection port are disconnected. The method includes connecting the liquid supply valve with the first flow channel of the liquid ejecting head, in a state where the second flow channel is fixed to the second connecting portion of the liquid supply valve and the liquid supply valve is in the second state, and switching the connection state of the liquid supply valve to the first state after the connecting. With this configuration, since the connection state of the liquid supply valve is switched to the second state or the third state in a state where the second flow channel is fixed to the second connecting portion of the liquid supply valve, dripping of a liquid from the second flow channel may be prevented when connecting the liquid supply valve to the first flow channel of the liquid ejecting head.

In this case, the method further includes supplying the liquid to the liquid ejecting head after the connection state of the liquid supply valve is switched to the first state in the switching, then switching the connection state of the liquid supply valve to the second state and sucking the liquid in the liquid ejecting head through the nozzle, and switching the connection state of the liquid supply valve from the second state to the first state in a state where inside of the liquid ejecting head is kept under negative pressure in the supplying, switching, and sucking. With this configuration, a liquid may be flowed at once into the liquid ejecting head from the second flow channel via the connecting flow channel in the supplying, switching, and sucking, and the switching. Therefore, air bubbles in the connecting flow channel may be discharged easily.

According to further another aspect of the invention, provided is a method of using a liquid supply valve for connecting a second flow channel, which supplies a liquid to a liquid ejecting head, with a first flow channel of the liquid ejecting head which includes a nozzle for ejecting the liquid. The liquid supply valve includes a valve casing, a first connecting portion that connects the first flow channel, a second connecting portion that connects the second flow channel, a first connection port that communicates with the first flow channel which is connected with the first connecting portion, a second connection port that communicates with the second flow channel which is connected with the second connecting portion, a valve body in which a connecting flow channel is formed for connecting the first connection port and the second connection port, and that is moved inside the valve casing to switch a connection state between the first connection port and the second connection port among a plurality of states, and an air release port that releases the first connection port to air. The plurality of states include a first state in which the first connection port and the second connection port communicate with each other via the connecting flow channel, and the first connection port and the air release port are disconnected, and a third state in which the first connection port and the second connection port are disconnected, and the first connection port and the air release port communicate with each other. The method includes switching the connection state of the liquid supply valve from the first state to the third state, sucking and discharging the liquid in the liquid supply valve and the liquid ejecting head through the nozzle, and detaching the liquid supply valve from the first flow channel of the liquid ejecting head. With this configuration, since a liquid in the liquid supply valve and a liquid in the liquid ejecting head may be discharged in the sucking and discharging before detaching the liquid supply valve from the first flow channel, dripping of the liquid may be prevented when the liquid supply valve is detached from the first flow channel of the liquid ejecting head in the detaching.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

Figure 1:
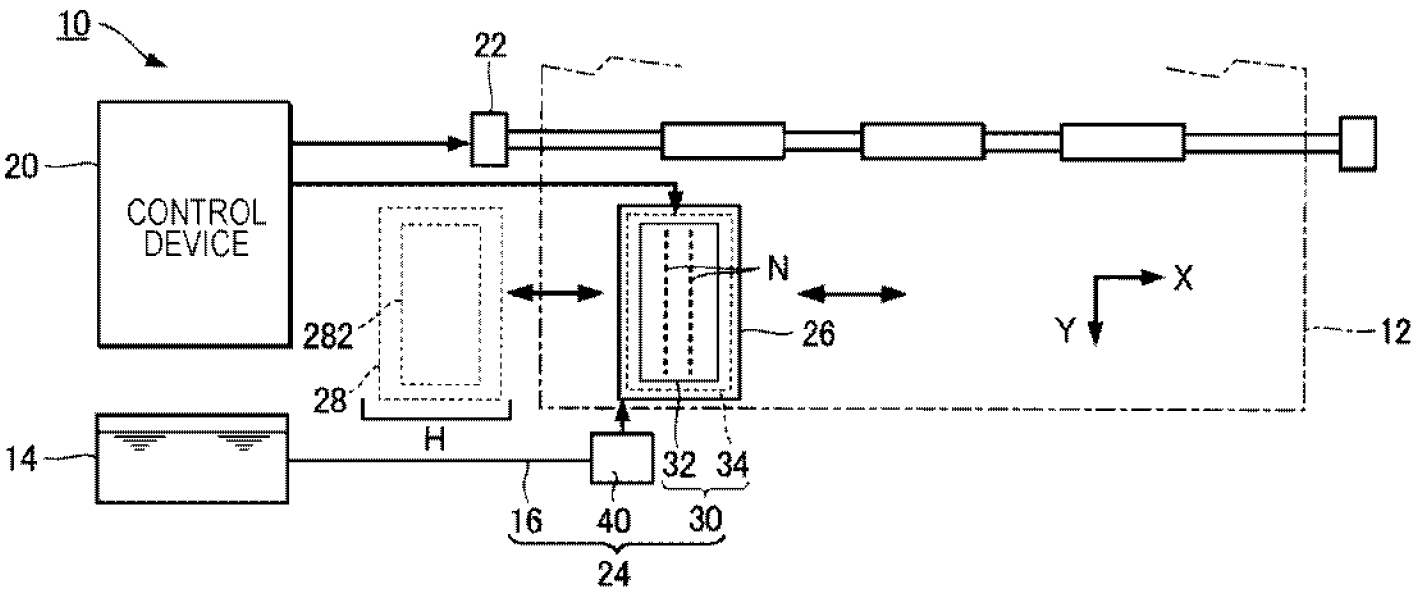
FIG. 1 illustrates a configuration of a liquid ejecting apparatus according to a first embodiment.

FIG. 1 illustrates a part of a configuration of a liquid ejecting apparatus 10 according to a first embodiment of the invention. The liquid ejecting apparatus 10 of the first embodiment is an ink jet printing apparatus which ejects ink which is a liquid at a medium 12, such as printing paper. The liquid ejecting apparatus 10 illustrated in FIG. 1 includes a control device 20, a transport mechanism 22, a liquid ejecting head 30, a carriage 26, and a maintenance unit 28. A liquid container (a cartridge) 14 which contains ink is attached to the liquid ejecting apparatus 10. The ink is supplied to the liquid ejecting head 30 from the liquid container 14 via a liquid supply pipe 16.

The control device 20 centrally controls the elements of the liquid ejecting apparatus 10. The transport mechanism 22 transports the medium 12 in a Y direction under the control of the control device 20. The liquid ejecting head 30 includes a liquid ejecting portion 32 and a flow channel unit 34. The flow channel unit 34 supplies ink from the liquid container 14 to the liquid ejecting portion 32. The liquid ejecting portion 32 ejects ink from each of a plurality of nozzles N at the medium 12 under the control of the control device 20. The liquid ejecting portion 32 includes a plurality of pressure chambers and piezoelectric elements (not illustrated) for different nozzles N. In response to a supplied drive signal, the piezoelectric element is vibrated to cause pressure variation inside the pressure chamber, whereby the ink contained in the pressure chamber is ejected from each nozzle N.

The maintenance unit 28 is disposed in a non-printing area H which is a home position (a standby position) of the carriage 26 in an X direction, for example. The maintenance unit 28 performs maintenance of the liquid ejecting head 30 when the carriage 26 is situated in the non-printing area H. The maintenance unit 28 includes a cap 282. The cap 282 is brought into contact with the liquid ejecting portion 32 to cover the nozzles N. The cap 282 then sucks thickened ink and air bubbles from the nozzles N with an unillustrated suction pump, and discharges the sucked ink and air bubbles into the cap 282.

The liquid ejecting head 30 is mounted on the carriage 26. The control device 20 makes the carriage 26 reciprocate in the X direction which crosses the Y direction. A desirable image is formed on a surface of the medium 12 when the liquid ejecting portion 32 ejects the ink at the medium 12 while the medium 12 is transported by the transport mechanism 22 and the carriage 26 is made to repetitively reciprocate.

The liquid supply pipe 16 is detachably connected with the liquid ejecting head 30 of the present embodiment via the liquid supply valve 40. The ink from the liquid supply pipe 16 is supplied to the liquid ejecting head 30 via the liquid supply valve 40. The liquid supply pipe 16 and the liquid supply valve 40 constitute a flow channel system 24 together with the liquid ejecting head 30.

Figure 2:
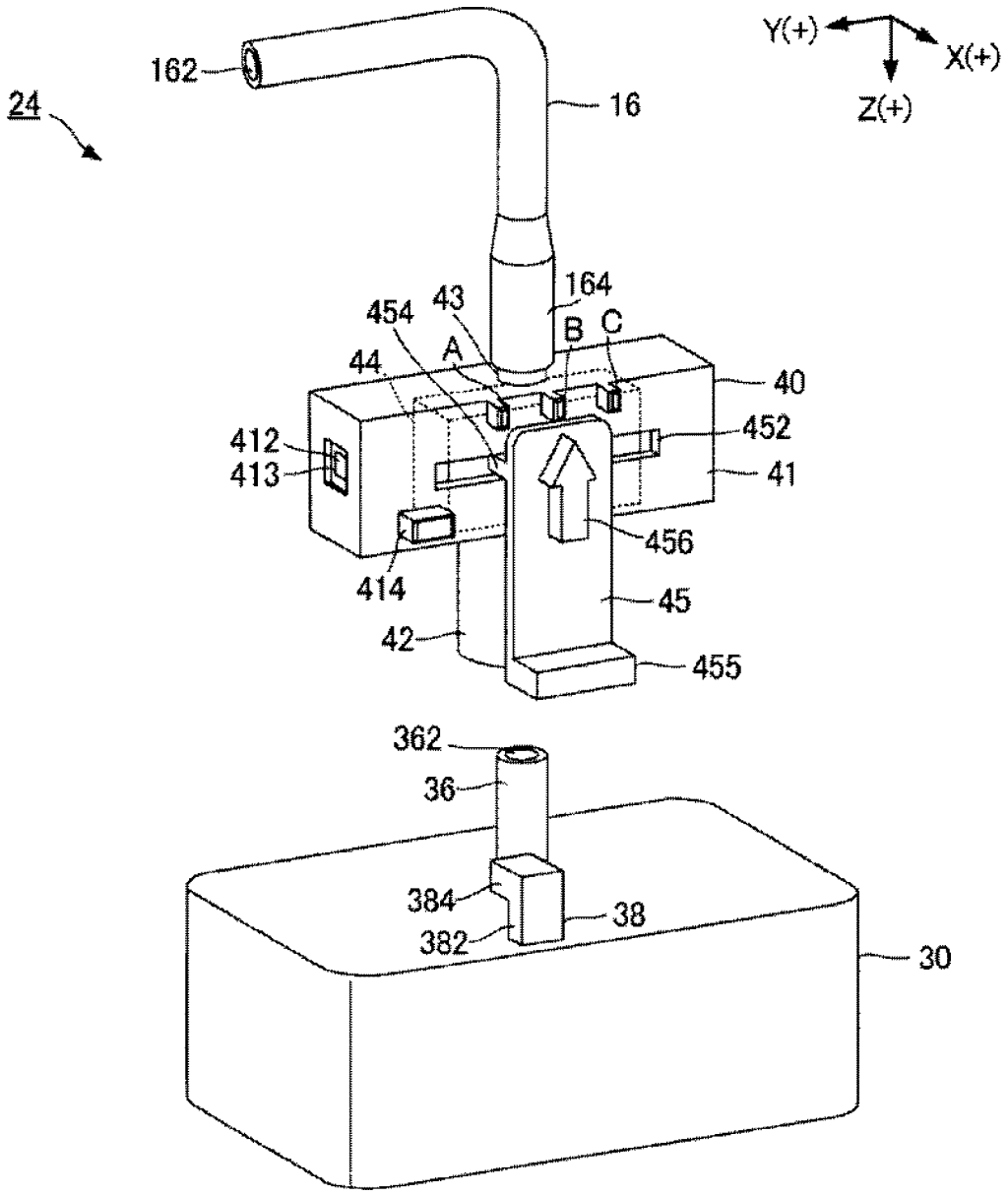
FIG. 2 is a perspective view of a flow channel system in which a liquid supply valve is detached.
Figure 3:
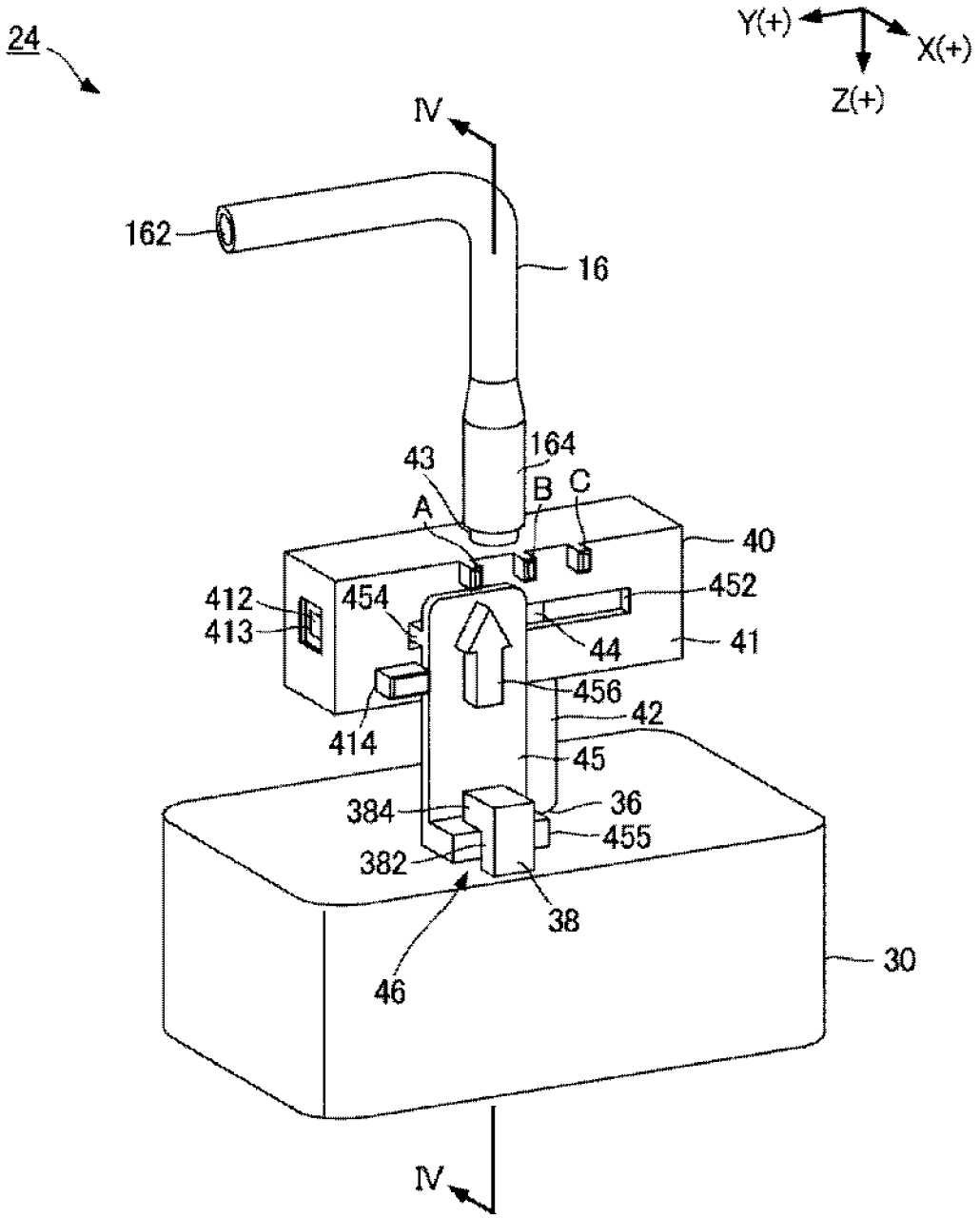
FIG. 3 is a perspective view of the flow channel system in which the liquid supply valve is attached.
Figure 4:
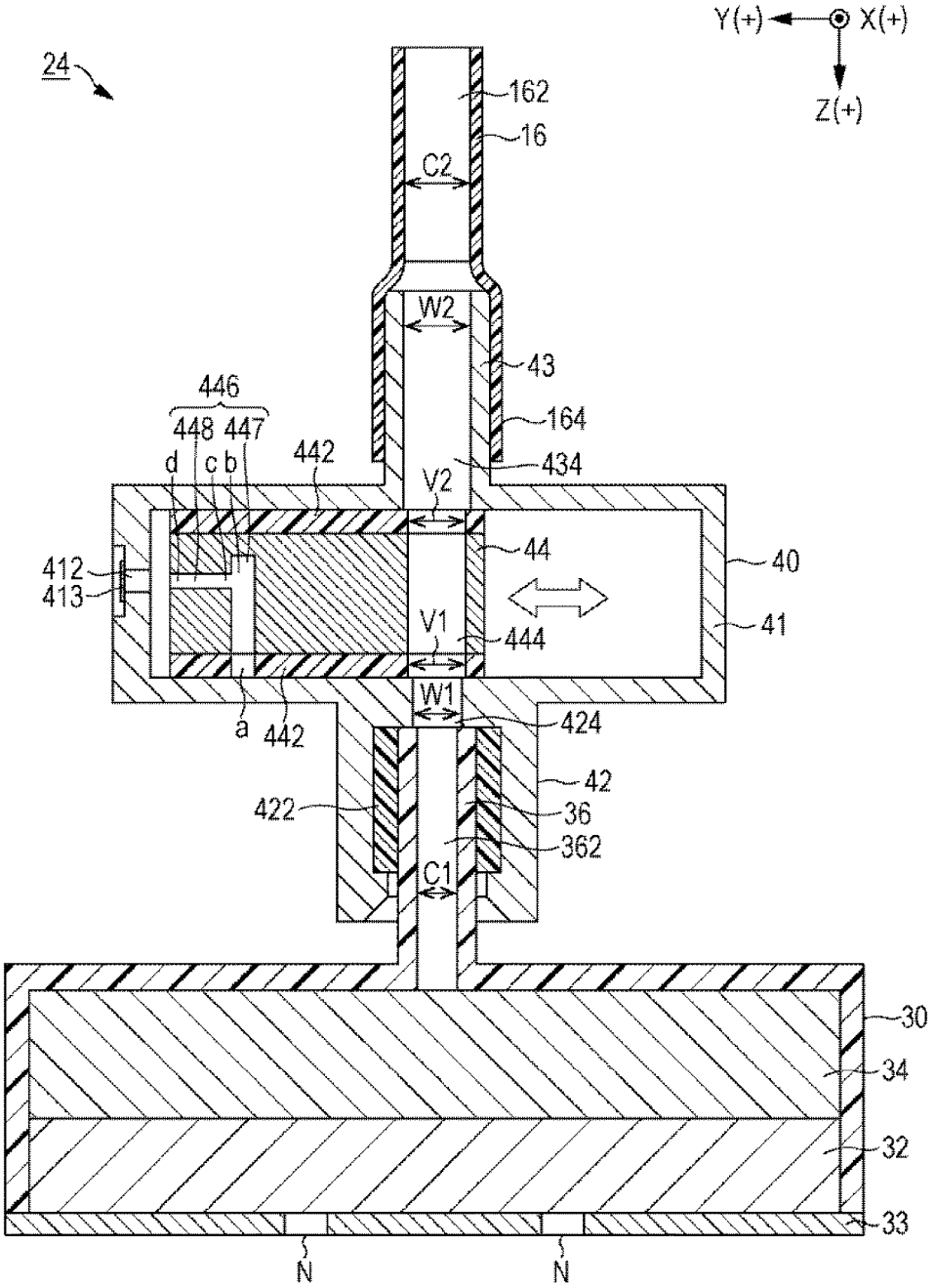
FIG. 4 is a cross-sectional view along line IV-IV of the flow channel system of FIG. 3.

FIGS. 2 and 3 are perspective views illustrating a part of a configuration of the flow channel system 24 according to the present embodiment. FIG. 2 illustrates a state where the liquid supply valve 40 to which the liquid supply pipe 16 is fixed is detached from the liquid ejecting head 30, and FIG. 3 illustrates a state where the liquid supply valve 40 to which the liquid supply pipe (an upstream side channel member) 16 is fixed is attached to the liquid ejecting head 30. A Z direction illustrated in FIGS. 2 and 3 is a direction perpendicular to an XY plane. FIG. 4 is a cross-sectional view along line IV-IV of the liquid supply valve 40 of FIG. 3. As illustrated in FIGS. 2 and 3, the liquid supply valve 40 is detachably attached to the liquid ejecting head 30 in a state where the liquid supply pipe 16 is fixed.

On an upper surface (a surface on a negative side of the Z direction) of the liquid ejecting head 30, a liquid introduction pipe (a downstream side channel member) 36 protruding upward from the upper surface is formed. The liquid introduction pipe 36 may be formed integrally with or separately from the upper surface of the liquid ejecting head 30.

As illustrated in FIG. 4, a first flow channel 362 is formed in the liquid introduction pipe 36. The first flow channel 362 communicates with the flow channel unit 34. The flow channel unit 34 supplies the ink introduced from the first flow channel 362 to the liquid ejecting portion 32, and the liquid ejecting portion 32 ejects the ink supplied via the flow channel unit 34 from the nozzles N. The nozzles N are formed on a nozzle plate 33. The liquid ejecting portion 32 is fixed on the negative side of the Z direction of the nozzle plate 33 in the liquid ejecting head 30. The number and the arrangement of the nozzles N are not limited to those illustrated in the drawing.

The liquid supply pipe 16 in which a second flow channel 162 of the present embodiment is formed is constituted by a flexible member (for example, flexible resin or rubber) whereas the liquid introduction pipe 36 in which the first flow channel 362 is formed is constituted by a non-flexible member (for example, non-flexible resin). That is, the non-flexible member which constitutes the liquid introduction pipe 36 may desirably have modulus of elasticity smaller than that of the flexible member which constitutes the liquid supply pipe 16. Since the liquid supply pipe 16 is made of a flexible member although the liquid introduction pipe 36 is constituted by a non-flexible member, the liquid ejecting head 30 may be easily driven by the carriage 26 and the liquid ejecting head 30 may be easily moved up and down in a state where the liquid supply valve 40 is attached to the liquid ejecting head 30.

As illustrated in FIGS. 2 and 3, the liquid supply valve 40 includes a rectangular parallelepiped-shaped hollow valve casing 41. A tubular first connecting portion 42 to be detachably connected with the first flow channel 362 is provided on a lower surface (a surface on the positive side of the Z direction) of the valve casing 41. The first connecting portion 42 protrudes downward from the lower surface of the valve casing 41. The liquid supply valve 40 is attached to the liquid ejecting head 30 with the liquid introduction pipe 36 of the liquid ejecting head 30 being inserted inside the first connecting portion 42.

Specifically, as illustrated in FIG. 4, a tubular sealing member 422 is attached inside the first connecting portion 42. The sealing member 422 is made of resin or rubber, for example. When the liquid introduction pipe 36 is inserted inside the first connecting portion 42, the first connecting portion 42 is sealed with the intervention of the sealing member 422 between an inner surface of the first connecting portion 42 and an outer surface of the liquid introduction pipe 36, thereby preventing liquid leakage. A first connection port 424 is formed on the lower surface of the valve casing 41. When the liquid introduction pipe 36 is connected with the first connecting portion 42, the first connection port 424 communicates with the first flow channel 362.

A tubular second connecting portion 43 to be connected with the second flow channel 162 formed in the liquid supply pipe 16 is provided on an upper surface (a surface on a negative side of the Z direction) of the valve casing 41. The second connecting portion 43 protrudes upward from the upper surface of the valve casing 41. The liquid supply pipe 16 is fixed to the liquid supply valve 40 with the second connecting portion 43 being inserted inside an end portion 164 of the liquid supply pipe 16. Since the liquid supply pipe 16 of the present embodiment is made of a flexible member, by forming a groove in an outer periphery (a contact surface with the liquid supply pipe 16) of the second connecting portion 43, a friction coefficient between the second connecting portion 43 and the liquid supply pipe 16 increases. Therefore, the liquid supply pipe 16 becomes less easily removed from the second connecting portion 43. The liquid supply pipe 16 may be fixed to the second connecting portion 43 with an adhesive. In that case, the adhesive may be easily held by forming a groove in the second connecting portion 43. The liquid supply pipe 16 may be fastened to the second connecting portion 43 with nuts or the like from the outside. In this case, the liquid supply pipe 16 may be firmly fixed to the second connecting portion 43. A second connection port 434 is formed on the upper surface of the valve casing 41. When the liquid supply pipe 16 is connected with the second connecting portion 43, the second connection port 434 communicates with the second flow channel 162.

In the liquid supply valve 40 of the present embodiment, since the liquid introduction pipe 36 (the downstream side channel member) is fixed in a manner more easily detached than the liquid supply pipe 16 (the upstream side channel member), the liquid supply valve 40 may be detached from the liquid introduction pipe 36 easily in a state where the liquid supply valve 40 is fixed to the liquid supply pipe 16.

A valve body 44 which is moved (driven) inside the valve casing 41 is provided in the valve casing 41. The valve body 44 of the present embodiment is slidingly movable in a longitudinal direction (in the positive and negative sides of the Y direction). The valve body 44 includes a sealing member 442 disposed between the valve body 44 and an inner surface of the valve casing 41. Since the valve body 44 is slidingly moved while being in contact with the sealing member 442 on the inner surface of the valve casing 41, the sealing member 442 is desirably made of a slidable member, such as resin. A connecting flow channel for making the first connection port 424 and the second connection port 434 communicate with each other is formed in the valve body 44. Since the valve body 44 is slidingly moved inside the valve casing 41, a connection state of the first connection port 424 and the second connection port 434 may be switched among a plurality of states.

Hereinafter, a configuration of the valve body 44 of the present embodiment will be described. As illustrated in FIG. 4, two connecting flow channels (a first connecting flow channel 444 and a second connecting flow channel 446) are separately formed in the valve body 44 of the present embodiment. The first connecting flow channel 444 is a connecting flow channel which makes the first connection port 424 and the second connection port 434 communicate with each other. The first connecting flow channel 444 penetrates the valve body 44 in the vertical direction (the Z direction). The second connecting flow channel 446 is a connecting flow channel which makes the first connection port 424 and an air release port 412 which opens on a side surface (a surface on the positive side of the Y direction) of the valve casing 41 communicate with each other. A filter 413 is provided in the air release port 412 to prevent ingress of foreign materials in the atmosphere into the valve casing 41.

The second connecting flow channel 446 is constituted by a main flow channel 447 extending in the vertical direction, and a communication channel 448 communicating with the main flow channel 447. One end portion a (a lower end) of the main flow channel 447 penetrates the lower surface of the valve body 44, and the other end portion b on the opposite side (an upper end) does not penetrate the upper surface. The communication channel 448 crosses the main flow channel 447, one end portion c (a right end) communicates with the other end portion b of the main flow channel 447, and the other end portion d on the opposite side (a left end) penetrates the side surface of the valve body 44. Therefore, the other end portion d of the communication channel 448 communicates with the air release port 412 via a space in the valve body 44. The first connecting flow channel 444 and the second connecting flow channel 446 are formed to penetrate the sealing member 442.

As illustrated in FIG. 4, the first connecting flow channel 444 and the second connecting flow channel 446 are disposed to be separated in the longitudinal direction (the Y direction) of the valve body 44. That is, the first connecting flow channel 444 is formed on the negative side of the Y direction and the second connecting flow channel 446 is formed on the positive side of the Y direction. No flow channel is formed between the first connecting flow channel 444 and the second connecting flow channel 446. In this valve body 44, a connection state between the first connection port 424 and the second connection port 434 may be switched among three states (a first state A, a second state B, and a third state C) depending on the position of the valve body 44 in the longitudinal direction of the valve casing 41.

Figure 5A:
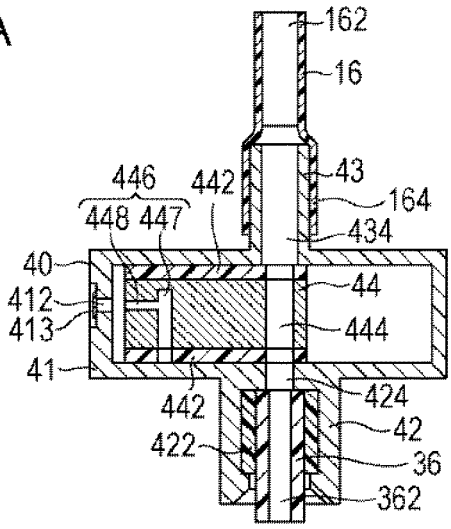
FIG. 5A is a cross-sectional view of the liquid supply valve in a first state.
Figure 5B:
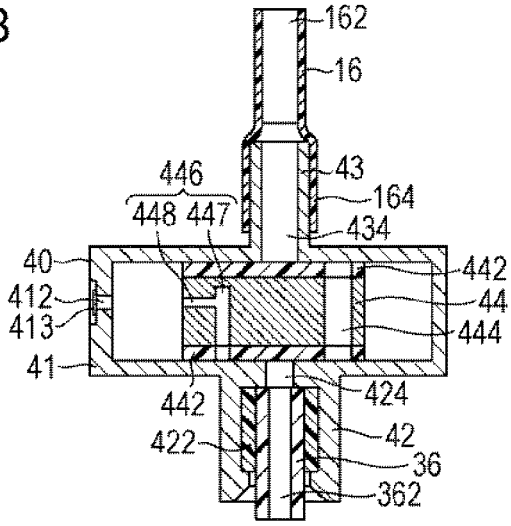
FIG. 5B is a cross-sectional view of the liquid supply valve in a second state.
Figure 5C:
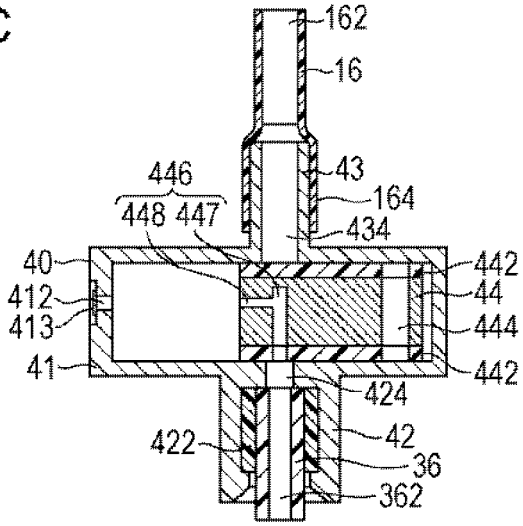
FIG. 5C is a cross-sectional view of the liquid supply valve in a third state.

FIGS. 5A to 5C are cross-sectional views illustrating the connection states at the first connection port 424 and the second connection port 434. FIG. 5A is a state where the valve body 44 is in the first state A, FIG. 5B is a state where the valve body 44 is in the second state B, and FIG. 5C is a state where the valve body 44 is in the third state C. As illustrated in FIG. 5A, in the first state A, the valve body 44 is at a position on the positive side of the Y direction and the first connection port 424 and the second connection port 434 communicate with each other via the first connecting flow channel 444. The air release port 412 is disconnected from both the first connection port 424 and the second connection port 434. By setting the state of the valve body 44 to the first state A while the liquid supply valve 40 is attached to the liquid ejecting head 30, the first flow channel 362 of the liquid introduction pipe 36 and the second flow channel 162 of the liquid supply pipe 16 communicate with each other.

Then, the ink from the liquid supply pipe 16 may be supplied to the liquid ejecting head 30.

As illustrated in FIG. 5C, in the third state C, the valve body 44 is at a position on the negative side of the Y direction. The first connection port 424 and the air release port 412 communicate with each other via the second connecting flow channel 446 while the second connection port 434 is disconnected from both the first connection port 424 and the air release port 412. As illustrated in FIG. 5B, in the second state B, the valve body 44 is situated at a position between the positions of the first state A and the second state B, and the first connection port 424 and the second connection port 434 are disconnected at this time. In either of the second state B or the third state C, the second flow channel 162 of the liquid supply pipe 16 is disconnected and the first flow channel 362 and the second flow channel 162 do not communicate with each other. Therefore, dripping of a liquid during attachment and detachment may be prevented by attaching and detaching the liquid supply valve 40 to and from the liquid ejecting head 30 after switching the valve body 44 to the second state B or the third state C.

In the third state C, since the communication channel 448 with the air release port 412 communicates with the end portion b on the opposite side of the end portion a of the main flow channel 447 connected with the first connection port 424 of the second connecting flow channel 446, dripping of the ink from the air release port 412 may be prevented by making the ink remaining in the second connecting flow channel 446 in the third state C flow toward the first connection port 424. Since the first connecting flow channel 444 and the air release port 412 do not communicate with each other, the ink in the first connecting flow channel 444 does not drip from the air release port 412.

By switching the valve body 44 to the third state C before detaching the liquid supply valve 40 from the liquid ejecting head 30, the ink remaining in the second connecting flow channel 446 which communicates with the first connection port 424 may be discharged by sucking through the nozzles N of the liquid ejecting head 30. Therefore, when detaching the liquid supply valve 40 from the liquid ejecting head 30, dripping of the ink which remains in the second connecting flow channel 446 may be prevented. By switching the valve body 44 to the third state C before detaching the liquid supply valve 40 from the liquid ejecting head 30, ink in the liquid ejecting head 30 may also be discharged from the nozzles N together with the ink remaining in the second connecting flow channel 446.

In the present embodiment, since the third state C is situated on the negative side of the Y direction more than the first state A and the second state B are, the valve body 44 may be switched to the first state A and the second state B not via the third state C. Therefore, the first flow channel 362 and the second flow channel 162 may be disconnected or made to communicate with each other without releasing the liquid ejecting head 30 to air. With this configuration, when the liquid supply valve 40 is attached to the liquid ejecting head 30, for example, the inside of the liquid ejecting head 30 may be sucked while keeping the first flow channel 362 and the second flow channel 162 disconnected in the second state B, and then the valve body 44 may be returned to the first state A and the first flow channel 362 and the second flow channel 162 may be made to communicate with each other. Therefore, the ink may be flowed into the liquid ejecting head 30 at once (head chalk sucking). Therefore, air bubbles inside the first connecting flow channel 444, air bubbles inside the first connection port 424, or air bubbles inside the second connection port 434 may be easily discharged.

As illustrated in FIG. 4, if a diameter of the first flow channel 362 is denoted by C1, a diameter of the second flow channel 162 is denoted by C2, a diameter of the first connection port 424 is denoted by W1, a diameter of the second connection port 434 is denoted by W2, a diameter of the first connecting flow channel 444 of a portion at which the first connecting flow channel 444 is connected with the first connection port 424 is denoted by V1, and a diameter of the first connecting flow channel 444 of a portion at which the first connecting flow channel 444 is connected with the second connection port 434 is denoted by V2, the following expression desirably holds: $C1 \leq W1 \leq V1 \leq V2 \leq W2 \leq C2$. At least the diameter V1 of the first connecting flow channel 444 of the portion at which the first connecting flow channel 444 is connected with the first connection port 424 is equal to or greater than the diameter W1 of the first connection port 424. At least the diameter V2 of the first connecting flow channel 444 of the portion at which the first connecting flow channel 444 is connected with the second connection port 434 is equal to or smaller than the diameter W2 of the second connection port 434. At least the diameter W1 of the first connection port 424 is equal to or smaller than the diameter W2 of the second connection port 434. With this configuration, if one of the diameters of the connection ports of the first connecting flow channel 444 is larger than the other, the first connecting flow channel 444 may be connected without requiring strict alignment. If the diameter V2 of the first connecting flow channel 444 on the upstream side is larger than the diameter V1 on the downstream side, trapping of air bubbles moved by buoyancy at a diameter-changing portion may be prevented. Since the valve body 44 may be reduced in size by reducing the diameter of the second connecting flow channel 446 to be smaller than the diameter of the first connecting flow channel 444, the entire size of the liquid supply valve 40 may be reduced.

As illustrated in FIGS. 2 and 3, a lever 45 for moving the valve body 44 from the outside of the valve casing 41 is provided in the liquid supply valve 40. By providing the lever 45, the valve body 44 may easily be moved so that a plurality of states (a first state A, a second state B, a third state C) may be switched. The lever 45 may be slidingly moved in the Y direction on a front surface (a surface on a positive side of the X direction) of the valve casing 41. An elongated hole 452 is formed on the front surface of the valve casing 41 along the longitudinal direction. A connecting portion 454 is provided on a back surface of the lever 45. The connecting portion 454 is inserted in the elongated hole 452 and is connected with the valve body 44. With this configuration, the valve body 44 may be slidingly moved by slidingly moving the lever 45 in the longitudinal direction.

An arrow-shaped mark 456 is formed on a front surface of the lever 45. A tip of the arrow of the mark 456 points upward. Three marks A, B, and C are formed on the front surface of the valve casing 41 along the longitudinal direction from the positive side to the negative side of the Y direction. When the tip of the arrow of the mark 456 of the lever 45 is aligned with a mark A, the valve body 44 may be aligned with the position of the first state A. When the tip of the arrow of the mark 456 of the lever 45 is aligned with a mark B, the valve body 44 may be aligned with the position of the second state B. When the tip of the arrow of the mark 456 of the lever 45 is aligned with a mark C, the valve body 44 may be aligned with the position of the third state C.

A regulating member 414 for regulating the movement of the valve body 44 is provided in the liquid supply valve 40 so as to keep at least one of the three states. As illustrated in FIG. 3, the regulating member 414 of the present embodiment regulates the movement of the valve body 44 at the position of the first state A illustrated in FIG. 5A among the three states. Specifically, the regulating member 414 is provided to protrude from the front surface of the valve casing 41 at a position on the positive side of the Y direction on the front surface of the valve casing 41, and regulates a sliding movement of the lever 45. The regulating member 414 protrudes from the front surface of the valve casing 41 more than the lever 45 does. With this configuration, when the lever 45 is slidingly moved on the positive side of the Y direction, the lever 45 stops at the position of the first state A with a side surface thereof abutting against the regulating member 414, and the lever 45 is regulated not to move on further the positive side of the Y direction. Since the movement of the valve body 44 is regulated by the regulating member 414, the valve body 44 is easily switched to the first state A. The lever 45 is freely moved to the positive side and the negative side of the Y direction until being regulated by the regulating member 414. Therefore, the positions of the valve body 44 in the three states A, B, and C may be freely adjusted until the lever 45 is regulated by the regulating member 414. With this configuration, in the three states A, B, and C, variation in tolerance caused by the position of the valve body 44 can be absorbed.

As illustrated in FIG. 3, the liquid supply valve 40 includes a locking mechanism 46 which sets the connection between the first connecting portion 42 of the valve casing 41 and the liquid introduction pipe 36 (the first flow channel 362) of the liquid ejecting head 30 to a locked state or an unlocked state. As illustrated in FIG. 3, the locking mechanism 46 is constituted by a hook member 38 provided on the upper surface of the liquid ejecting head 30 and a bent portion 455 of the lever 45 to engage with the hook member 38. The hook member 38 is constituted by an upright portion 382 which rises up from the upper surface of the liquid ejecting head 30 and a protruding portion 384 protruding from an upper end of the upright portion 382 on the negative side of the X direction. The bent portion 455 of the lever 45 is formed to be bent on the positive side of the X direction at a lower end of the lever 45.

When the lever 45 is slidingly moved, the bent portion 455 of the lever 45 enters a gap between the protruding portion 384 of the hook member 38 and the upper surface of the liquid ejecting head 30, and the lever 45 is fixed to the hook member 38. Therefore, the connection between the first connecting portion 42 of the valve casing 41 and the liquid introduction pipe 36 (the first flow channel 362) of the liquid ejecting head 30 is set to a locked state, and the liquid supply valve 40 is not removed from the liquid ejecting head 30. In the present embodiment, the hook member 38 is formed at a position where the connection is set to the locked state at the position of the first state A illustrated in FIG. 5A. Therefore, at positions other than the position of the first state A, that is, at positions of the second state B and the third state C, the bent portion 455 of the lever 45 is removed from the gap between the protruding portion 384 of the hook member 38 and the upper surface of the liquid ejecting head 30. Therefore, the connection is set to an unlocked state.

Method of Using Liquid Supply Valve

Next, a method of using the liquid supply valve 40 of the present embodiment will be described. As described above, the liquid supply valve 40 of the present embodiment is fixed to the end portion 164 of the liquid supply pipe 16 when the liquid supply pipe 16 is attached to and detached from the liquid introduction pipe 36 of the liquid ejecting head 30. Specifically, the liquid supply valve 40 is attached to and detached from the liquid ejecting head 30 while switching the state of the valve body 44 by slidingly moving the valve body 44. Therefore, dripping of a liquid during attachment and detachment may be prevented.

When Attaching Liquid Supply Valve 40

Figure 6A:
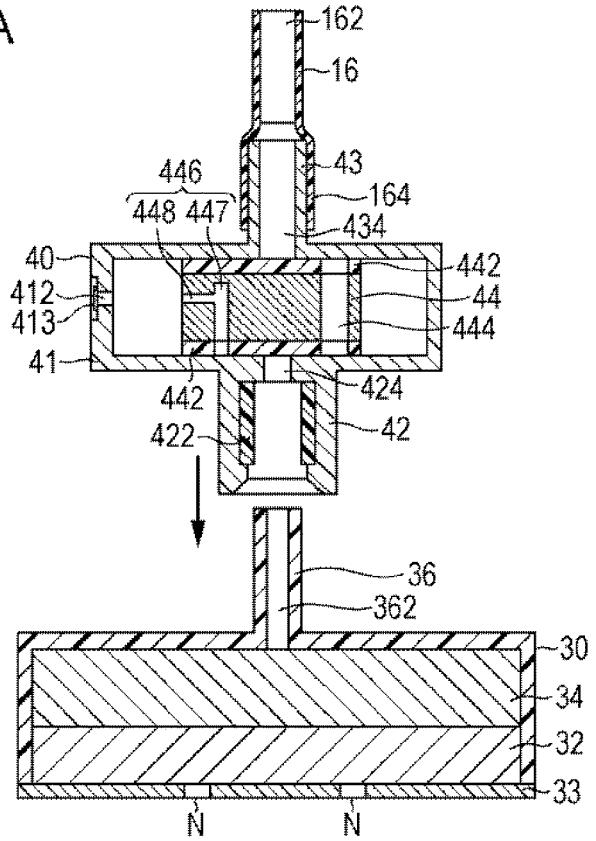
FIG. 6A is a cross-sectional view illustrating a process to attach the liquid supply valve in a method of using.

FIGS. 6A to 6D are cross-sectional views illustrating a process to attach the liquid supply valve 40 to the liquid ejecting head 30 in the method of using the liquid supply valve 40. When attaching the liquid supply valve 40 to the liquid ejecting head 30, first, as illustrated in FIG. 6A, the valve body 44 is set to the second state B, and then the liquid supply valve 40 is attached to the liquid ejecting head 30 (a first process). The valve body 44 is set to the second state B by aligning the mark 456 of the lever 45 with the mark B illustrated in FIG. 2. When the valve body 44 is set to the second state B, the first flow channel 362 of the liquid introduction pipe 36 and the second flow channel 162 of the liquid supply pipe 16 are disconnected by the valve body 44, whereby the first flow channel 362 and the second flow channel 162 stop communicating with each other. Dripping of the liquid during attachment may be prevented by attaching the liquid ejecting head 30 to the liquid supply valve 40 in the second state B.

Figure 6B:
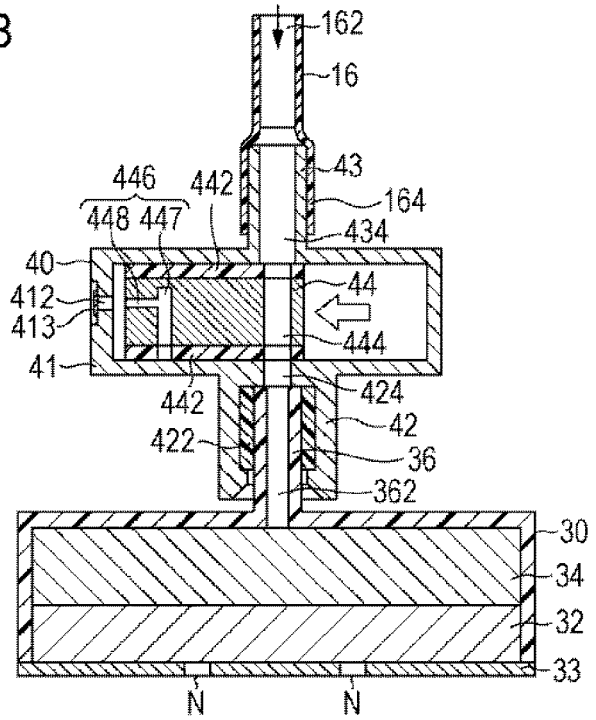
FIG. 6B is a cross-sectional view illustrating a process following the process of FIG. 6A.

In the first process, after setting the valve body 44 to the third state C, the liquid supply valve 40 may be attached to the liquid ejecting head 30 as illustrated in FIG. 6B. In this case, the valve body 44 is set to the third state C by aligning the mark 456 of the lever 45 with the mark C illustrated in FIG. 2. Even after the valve body 44 is set to the third state C, the second flow channel 162 is disconnected by the valve body 44, and the first flow channel 362 and the second flow channel 162 do not communicate with each other, when the liquid supply valve 40 is attached to the liquid ejecting head 30 in the third state C, dripping of a liquid during attachment may be prevented. Since the first flow channel 362 of the liquid ejecting head 30 is released to air in the third state C, the liquid supply valve 40 is easily attached to the liquid ejecting head 30. By attaching in the third state C if a liquid exists in the liquid ejecting head 30, pressure variation inside the first connection port 424 during attachment may be reduced. Therefore, dripping of a liquid in the liquid ejecting head 30 due to pressure variation inside the first connection port 424 may be reduced.

Next, as illustrated in FIG. 6B, the liquid supply valve 40 is switched to the first state A (a second process). The valve body 44 is set to the first state A by aligning the mark 456 of the lever 45 with the mark A illustrated in FIG. 3. By switching the valve body 44 to the first state A, the first flow channel 362 of the liquid introduction pipe 36 and the second flow channel 162 of the liquid supply pipe 16 communicate with each other, whereby the ink from the liquid supply pipe 16 can be supplied to the liquid ejecting head 30. Since the lever 45 is set to a locked state by the locking mechanism 46 as illustrated in FIG. 3, the liquid supply valve 40 is not removed from the liquid ejecting head 30. Although printing may be performed in this state, air bubbles in the first connecting flow channel 444 are discharged by processes illustrated in FIGS. 6C and 6D before printing in the present embodiment.

Figure 6C:
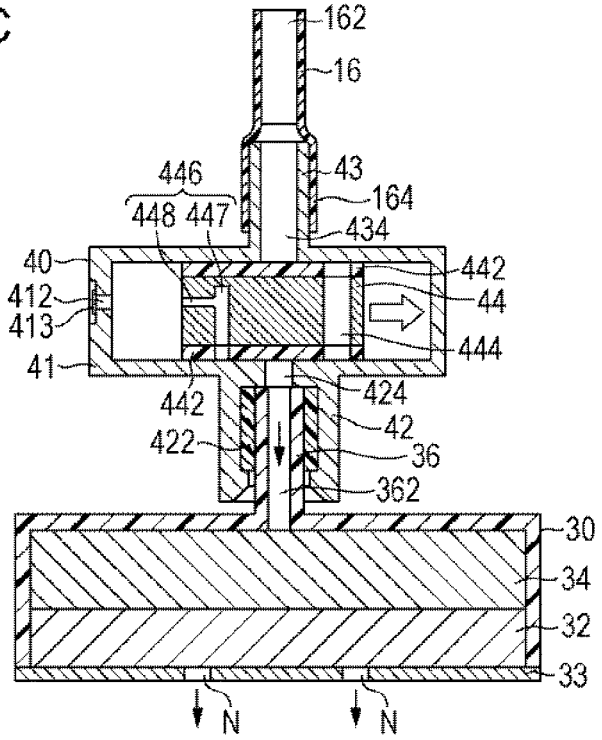
FIG. 6C is a cross-sectional view illustrating a process following the process of FIG. 6B.
Figure 6D:
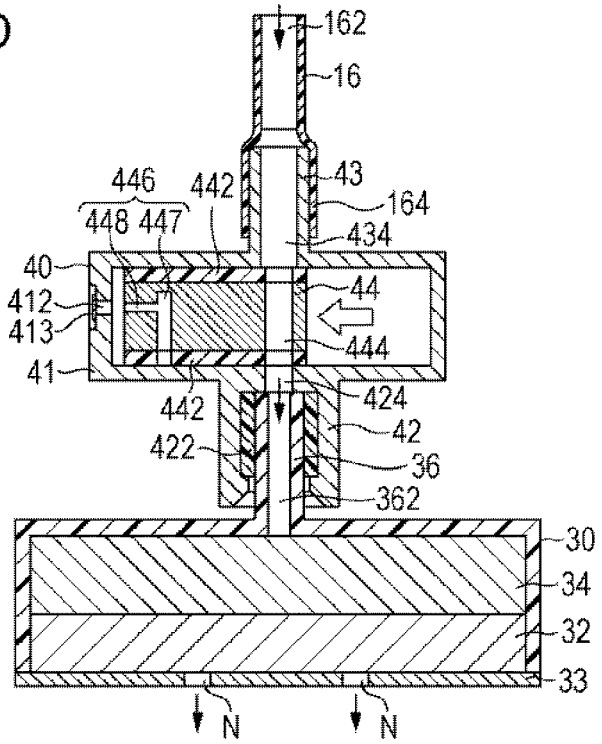
FIG. 6D is a cross-sectional view illustrating a process following the process of FIG. 6C.

That is, the ink from the liquid supply pipe 16 is supplied to the liquid ejecting head 30 in the first state A of FIG. 6B, and the liquid ejecting head 30 is filled with the ink. Then, as illustrated in FIG. 6C, the liquid supply valve 40 is switched to the second state B, and the ink in the liquid ejecting head 30 is sucked through the nozzles N (a third process). When the liquid ejecting head 30 is in the non-printing area H, for example, the cap 282 is brought into contact with the liquid ejecting portion 32 by the maintenance unit 28 to cover the nozzles N. The cap 282 sucks thickened ink and air bubbles from the nozzles N with an unillustrated suction pump. Since the first flow channel 362 of the liquid introduction pipe 36 is disconnected by the valve body 44, negative pressure in the liquid introduction pipe 36 increases.

The valve body 44 is switched from the second state B to the first state A in the state where inside of the liquid ejecting head 30 is kept under negative pressure in the third process (a fourth process). Since the first flow channel 362 of the liquid introduction pipe 36 communicates with the second flow channel 162 of the liquid supply pipe 16 via the first connecting flow channel 444, the ink can be flowed at once into the liquid ejecting head 30 from the second flow channel 162 via the first connecting flow channel 444. Therefore, air bubbles inside the first connecting flow channel 444 may be easily discharged by the pressure variation and the flow of the ink. In this state, printing may be performed.

When Detaching Liquid Supply Valve 40

FIGS. 7A to 7D are cross-sectional views illustrating a process to detach the liquid supply valve 40 from the liquid ejecting head 30 in the method of using the liquid supply valve 40. In detaching the liquid supply valve 40 from the liquid ejecting head 30, the valve body 44 is first switched from the first state A illustrated in FIG. 7A to the third state C illustrated in FIG. 7B (a first' process). Then, in a state where the second connection port 434 is disconnected, the first flow channel 362 and the air release port 412 communicate with each other via the second connecting flow channel 446.

Figure 7A:
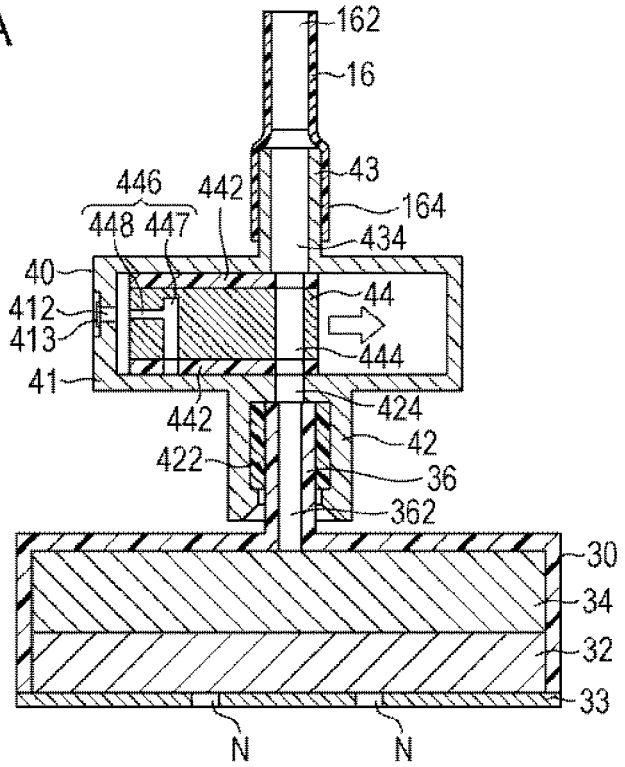
FIG. 7A is a cross-sectional view illustrating a process to detach the liquid supply valve in a method of using.
Figure 7B:
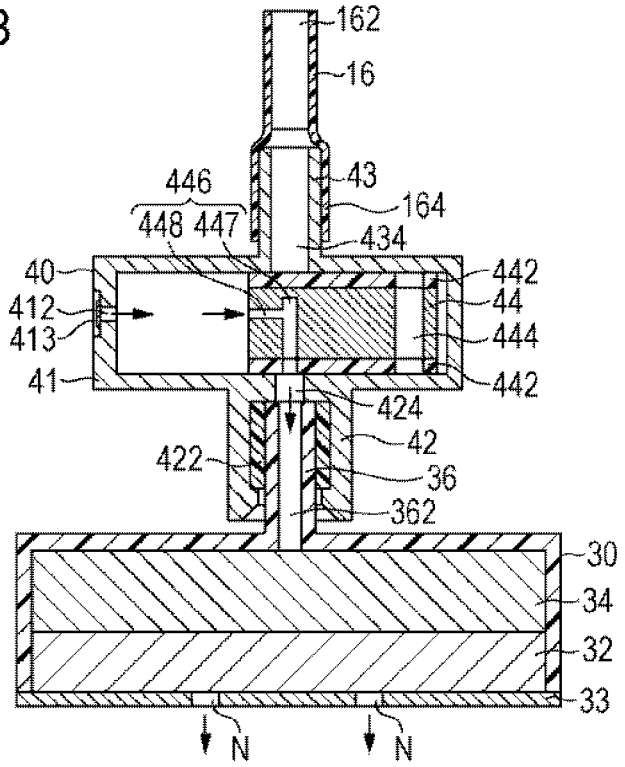
FIG. 7B is a cross-sectional view illustrating a process following FIG. 7A.

Next, as illustrated in FIG. 7B, ink in the liquid supply valve 40 and the liquid ejecting head 30 is sucked and discharged through the nozzles N (a second' process). When the liquid ejecting head 30 is in the non-printing area H, for example, the cap 282 is brought into contact with the liquid ejecting portion 32 by the maintenance unit 28 to cover the nozzles N. The cap 282 sucks thickened ink and air bubbles from the nozzles N with an unillustrated suction pump.

Figure 7C:
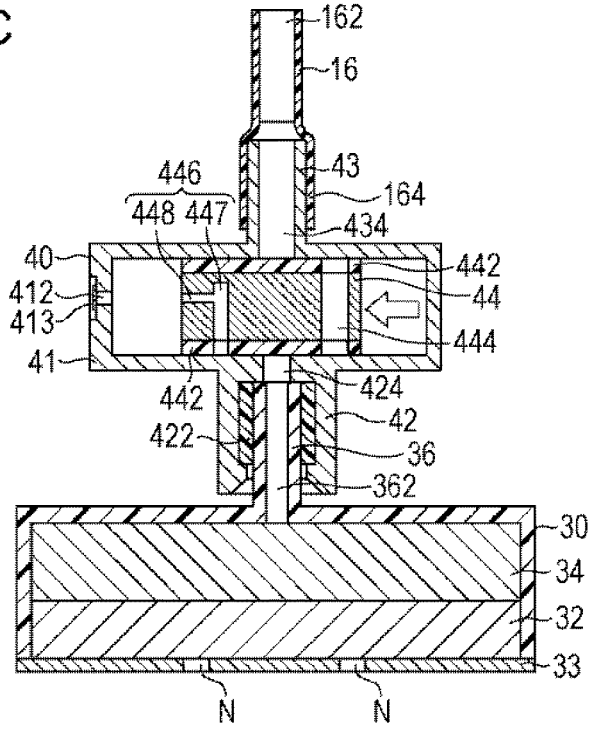
FIG. 7C is a cross-sectional view illustrating a process following the process of FIG. 7B.
Figure 7D:
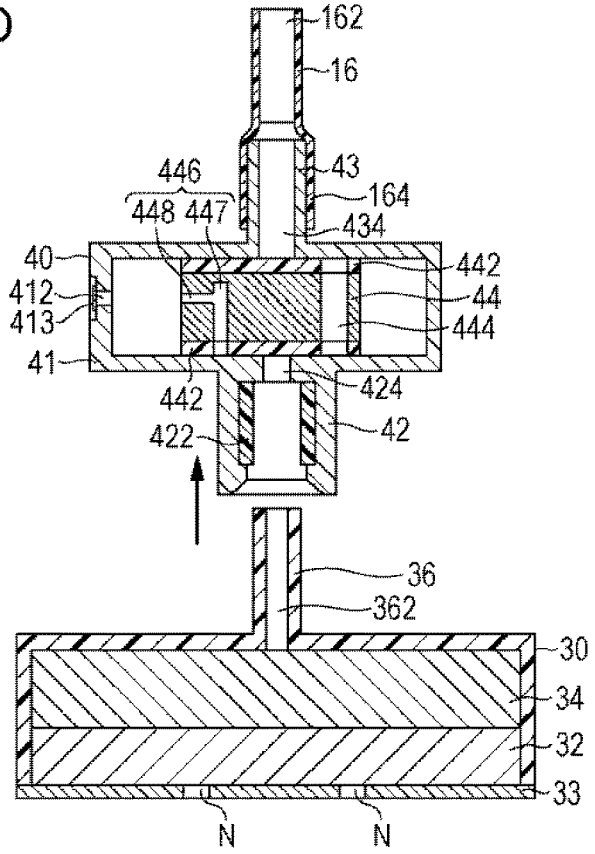
FIG. 7D is a cross-sectional view illustrating a process following the process of FIG. 7C.

Then, as illustrated in FIG. 7C, after switching the valve body 44 to the second state, the liquid supply valve 40 is detached from the liquid ejecting head 30 (a third' process). Since the first flow channel 362 and the second flow channel 162 are disconnected by the valve body 44 after the valve body 44 is switched to the second state, dripping of a liquid during detachment of the liquid supply valve 40 from the liquid ejecting head 30 may be prevented. Further, since the ink in the liquid supply valve 40 and the liquid ejecting head 30 is sucked and discharged from the nozzles N in the second' process, dripping of the ink in the liquid supply valve 40 may also be prevented. In the third' process, the liquid supply valve 40 may be detached from the liquid ejecting head 30 while the valve body 44 is still in the third state C. Since the first flow channel 362 of the liquid ejecting head 30 is released to air in the third state C, the liquid supply valve 40 is easily detached from the liquid ejecting head 30.

The valve body 44 of the present embodiment switches the connection state of the first flow channel 362 and the second flow channel 162 to a plurality of states (the first state A, the second state B, and the third state C). Therefore, when the first flow channel 362 and the second flow channel 162 are disconnected or made to communicate with each other, capacity of the first connecting flow channel 444 and the second connecting flow channel 446 may be kept constant. Therefore, as compared with a case where the liquid supply pipe 16 is fixed with a clip or the like so that the liquid supply pipe 16 is deformed and capacity thereof is changed, pushing out or pulling back of the ink with respect to the liquid ejecting head 30 may be reduced, whereby meniscuses in the nozzles N are less easily destroyed.

A valve mechanism (for example, a pressure regulating valve and a pressure control valve) for keeping pressure in the first flow channel 362 constant is provided in the flow channel unit 34 of the liquid ejecting head 30. Since the first connecting portion 42 is connected via the valve mechanism, the valve mechanism is disposed downstream of the liquid supply valve 40. Since the liquid supply valve 40 may be detached from the liquid ejecting head 30 while the pressure in the first flow channel 362 is kept constant by the valve mechanism, an effect of preventing dripping of a liquid may be improved as compared with a case where the valve mechanism is not disposed downstream of the liquid supply valve 40.

Second Embodiment

A second embodiment of the invention will be described. In each form described below, elements having the same effects and functions as those of the first embodiment are denoted by the same reference numerals used in the description of the first embodiment, and detailed description will be omitted. The valve body 44 in the liquid supply valve 40 of the first embodiment is slidingly moved whereas a valve body 44 in a liquid supply valve 40 of the second embodiment is rotated about a line G-G along an X direction.

Figure 8:
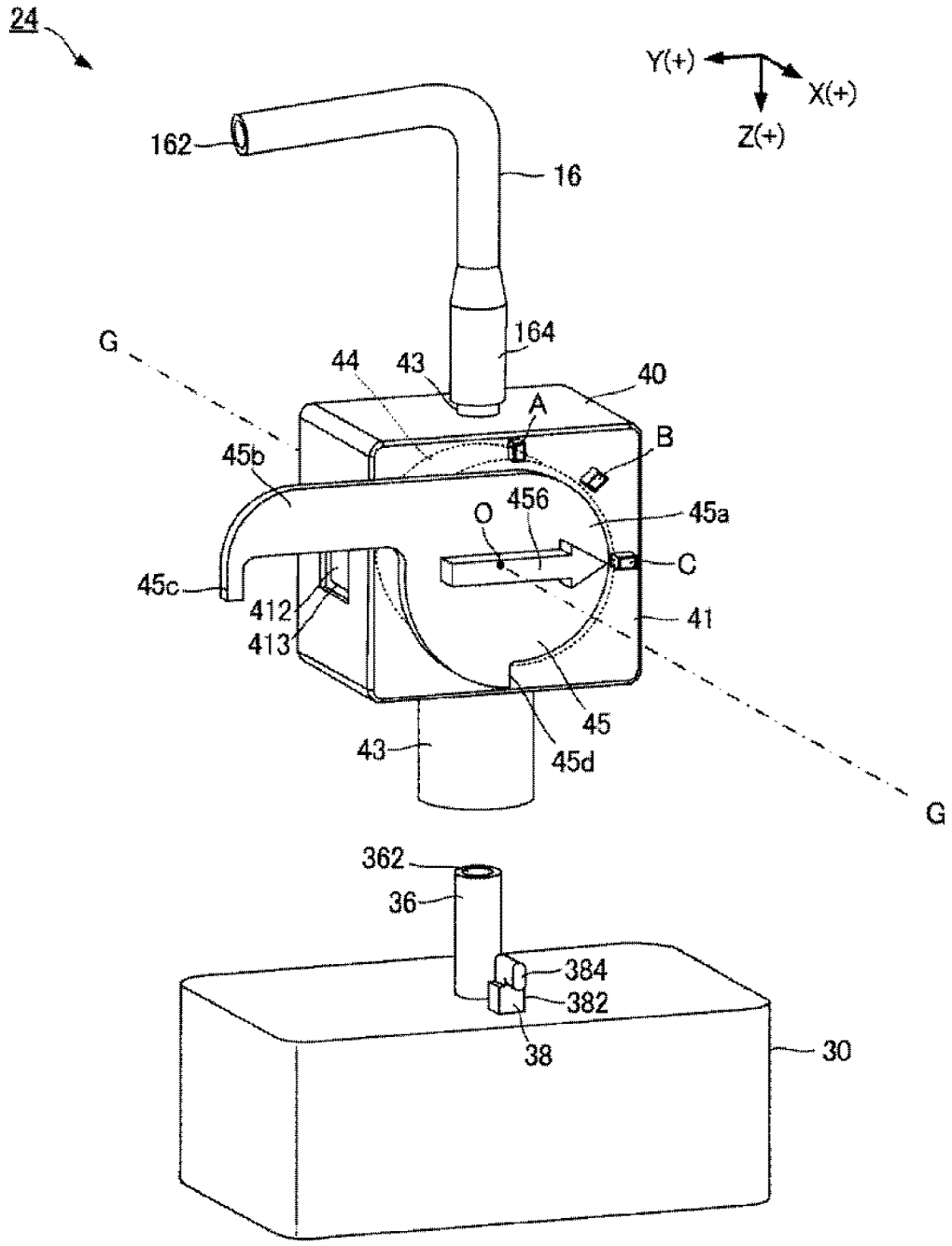
FIG. 8 is a perspective view of a flow channel system according to a second embodiment in which a liquid supply valve is detached.
Figure 9:
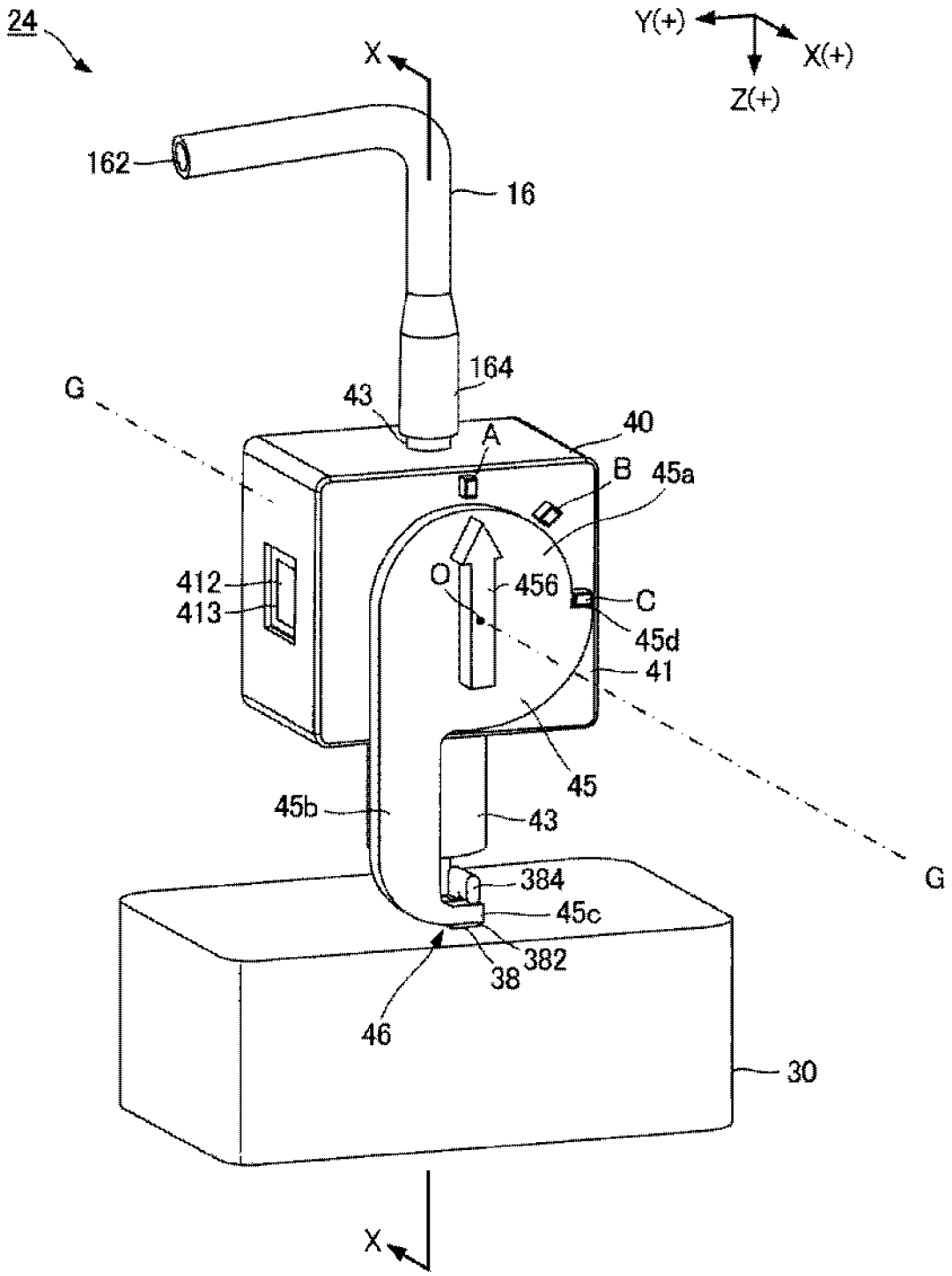
FIG. 9 is a perspective view of the flow channel system according to the second embodiment in which the liquid supply valve is attached.
Figure 10:
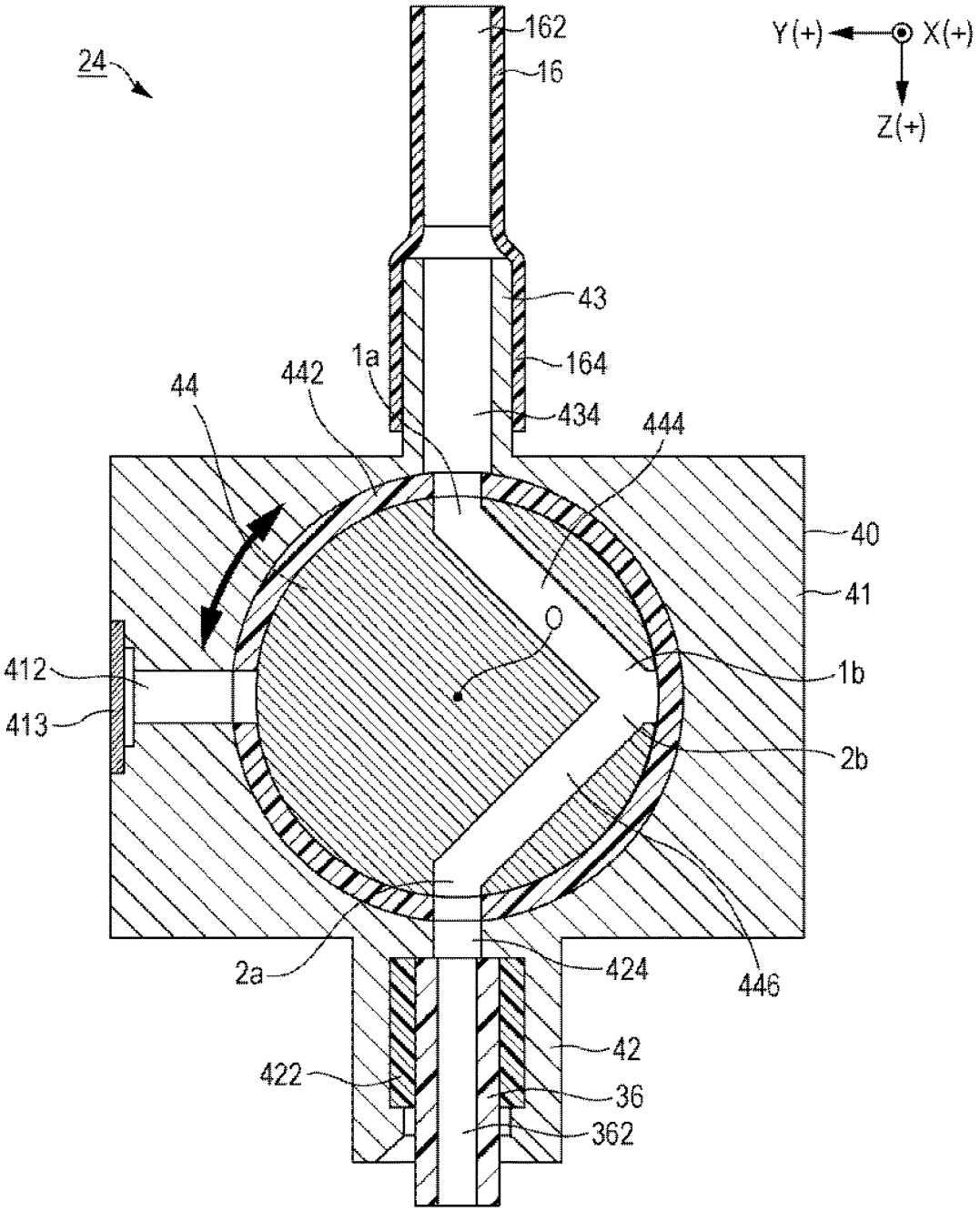
FIG. 10 is a cross-sectional view along line X-X of the flow channel system of FIG. 9.

FIGS. 8 and 9 are perspective views illustrating a part of a configuration of a flow channel system 24 according to the second embodiment. FIG. 8 illustrates a case where the liquid supply valve 40 to which a liquid supply pipe 16 is fixed is detached from a liquid ejecting head 30, and FIG. 9 illustrates a case where the liquid supply valve 40 to which the liquid supply pipe 16 is fixed is attached to the liquid ejecting head 30. FIG. 10 is a cross-sectional view along line X-X of the liquid supply valve 40 illustrated in FIG. 9. As illustrated in FIGS. 8 and 9, the liquid supply valve 40 of the second embodiment is also detachably attached to the liquid ejecting head 30 in a state where the liquid supply pipe 16 is fixed to the liquid supply valve 40 as in the first embodiment. As illustrated in FIG. 8, in the liquid supply valve 40 of the second embodiment, a disc-shaped valve body 44 is provided to be rotatable in a valve casing 41. The valve body 44 is rotated about a virtual line G-G along an X direction which passes through the center O of the valve body 44.

As illustrated in FIG. 10, two connecting flow channels (a first connecting flow channel 444 and a second connecting flow channel 446) are formed in the valve body 44. An end portion 1*b* of the first connecting flow channel 444 and an end portion 2*b* of the second connecting flow channel 446 of the second embodiment communicate with each other to form a single substantially V-shaped connecting flow channel. In the second embodiment, a connection state between a first connection port 424 and a second connection port 434 may be switched among three states (a first state A, a second state B, and a third state C) as in the first embodiment depending on rotational positions of the first connecting flow channel 444 and the second connecting flow channel 446 which form a substantially V-shape.

Figure 11A:
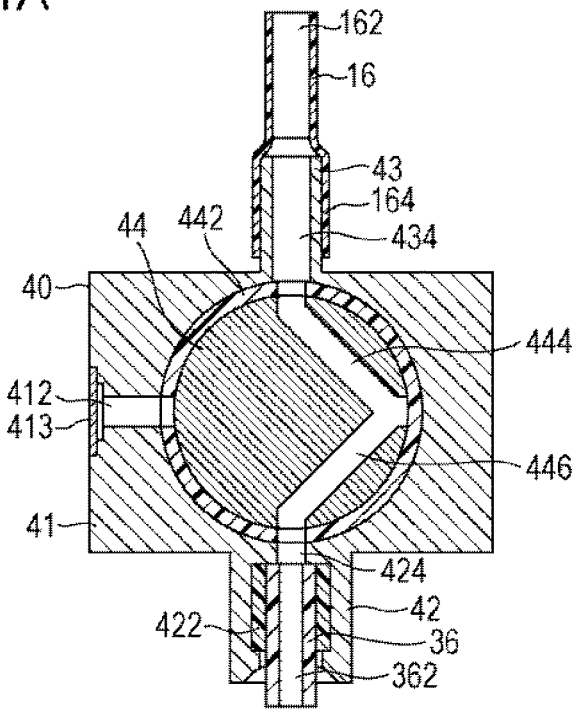
FIG. 11A is a cross-sectional view of a liquid supply valve in a first state.
Figure 11B:
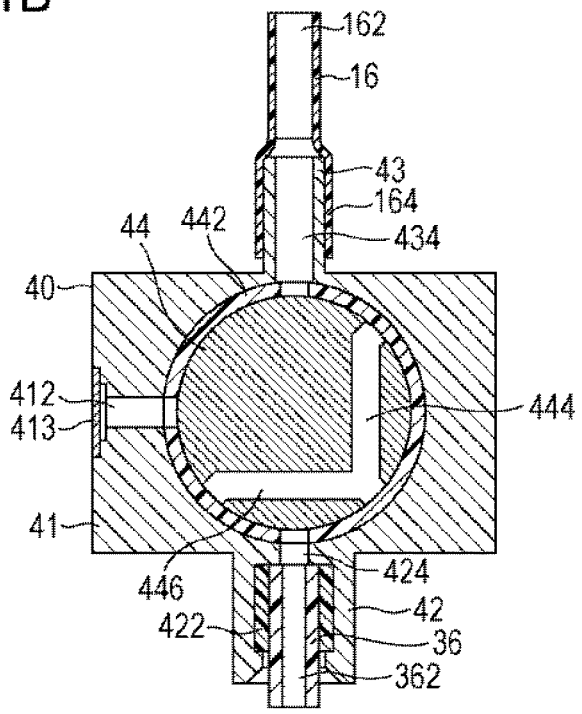
FIG. 11B is a cross-sectional view of the liquid supply valve in a second state.
Figure 11C:
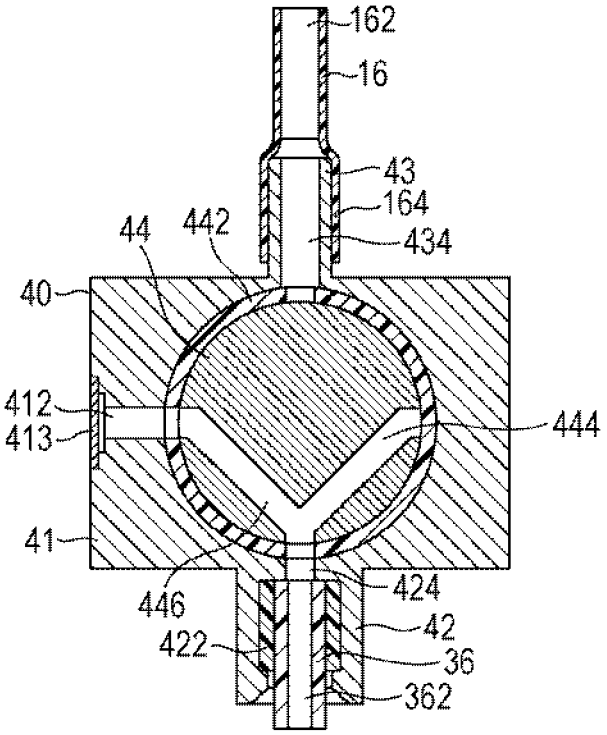
FIG. 11C is a cross-sectional view of the liquid supply valve in a third state.

FIGS. 11A to 11C are cross-sectional views illustrating the connection states at the first connection port 424 and the second connection port 434. FIG. 11A is a state where the valve body 44 is in the first state A, FIG. 11B is a state where the valve body 44 is in the second state B, and FIG. 11C is a state where the valve body 44 is in the third state C. As illustrated in FIG. 11A, in the first state A, one end portion 1*a* of the first connecting flow channel 444 communicates with the second connection port 434, and one end portion 2*a* of the second connecting flow channel 446 communicates with the first connection port 424. Since the other end portion 1*b* of the first connecting flow channel 444 and the other end portion 2*b* of the second connecting flow channel 446 communicate with each other, a first flow channel 362 and a second flow channel 162 communicate with each other via the first connecting flow channel 444 and the second connecting flow channel 446 in the first state A.

As illustrated in FIG. 11C, in the third state C, one end portion 2*a* of the second connecting flow channel 446 communicates with an air release port 412, and the other end portion 2*b* of the second connecting flow channel 446 communicates with the first connection port 424. In the third state C, the second connection port 434 is disconnected. As illustrated in FIG. 11B, in the second state B, the valve body 44 is situated at a position between the positions of the first state A and the third state C. In the second state B, the first connection port 424 and the second connection port 434 are disconnected.

As illustrated in FIG. 8, a lever 45 of the second embodiment is provided to be rotatable about the line G-G on a front surface (a surface on the positive side of the X direction) of the valve casing 41. A shaft (not illustrated) of the lever 45 is connected with a shaft (not illustrated) of the valve body 44, and a rotational position of the valve body 44 may be changed when the lever 45 is rotated. The lever 45 illustrated in FIG. 8 is constituted by a disk portion 45*a* and an extending portion 45*b*. The extending portion 45*b* extends outward from a part of an outer periphery of the disk portion 45*a*. A bent portion 45*c* which is bent counterclockwise is formed at an end of the extending portion 45*b*. A hook member 38 of the second embodiment is constituted by an upright portion 382 which rises up from the upper surface of the liquid ejecting head 30 and a protruding portion 384 protruding from an upper end of the upright portion 382 on the positive side of the X direction.

When the lever 45 situated at the position of FIG. 8 is rotated counterclockwise about line G-G, as illustrated in FIG. 9, the bent portion 45*c* of the lever 45 enters a gap between the protruding portion 384 of the hook member 38 and the upper surface of the liquid ejecting head 30, and the lever 45 is fixed to the hook member 38. Therefore, a connection between a first connecting portion 42 of the valve casing 41 and a liquid introduction pipe 36 (the first flow channel 362) of the liquid ejecting head 30 is set to a locked state, and the liquid supply valve 40 is not removed from the liquid ejecting head 30. In the second embodiment, the hook member 38 is formed at a position where the connection is set to the locked state at the position of the first state A illustrated in FIG. 11A. Therefore, at positions other than that in the first state A, that is, positions in the second state B and the third state C, since the bent portion 45*c* of the lever 45 is removed from the gap between the protruding portion 384 of the hook member 38 and the upper surface of the liquid ejecting head 30, the lever 45 is set to an unlocked state.

Three marks A, B, and C are formed clockwise on the front surface of the valve casing 41 of the second embodiment. An arrow-shaped mark 456 is formed on a front surface of the lever 45. The valve body 44 may be aligned with a position of the first state A by aligning a tip of the arrow of the mark 456 of the lever 45 with a mark A. The valve body 44 may be aligned with a position of the second state B by aligning the tip of the arrow of the mark 456 of the lever 45 with a mark B. The valve body 44 may be aligned with a position of the third state C by aligning the tip of the arrow of the mark 456 of the lever 45 with a mark C.

The marks A, B, and C of the second embodiment are formed to protrude from the front surface of the valve casing 41. The mark C functions as a regulating member which holds the first state A of the valve body 44. Specifically, a protruding portion 45*d* protruding outward in a radial direction is formed at a part of an outer periphery of the disk portion 45*a* of the lever 45 of FIG. 8, and counterclockwise rotation of the lever 45 is regulated by the mark C as the regulating member which abuts a protruding portion 45*d*. When the lever 45 is rotated counterclockwise, the protruding portion 45*d* of the lever 45 abuts the mark C and the lever 45 stops at the position of the first state A, whereby further counterclockwise rotation is regulated. The lever 45 is freely moved counterclockwise or clockwise until being regulated by the mark C as the regulating member. Therefore, the positions of the valve body 44 in the three states A, B, and C may be freely adjusted until the lever 45 is regulated by the mark C as the regulating member.

The liquid supply valve 40 of the configuration described above according to the second embodiment is fixed to an end portion 164 of the liquid supply pipe 16 when the liquid supply pipe 16 is attached to and detached from the liquid introduction pipe 36 of the liquid ejecting head 30. Specifically, the liquid supply valve 40 is attached to and detached from the liquid ejecting head 30 while switching the state of the valve body 44 by rotating the valve body 44. Therefore, dripping of a liquid during attachment and detachment is prevented. Since the liquid supply valve 40 of the second embodiment is switchable to the first state A, the second state B, and the third state C as in the first embodiment, the liquid supply valve 40 may be used in the same manner as in the first embodiment, and the same effect can be provided.

Third Embodiment

Figure 12:
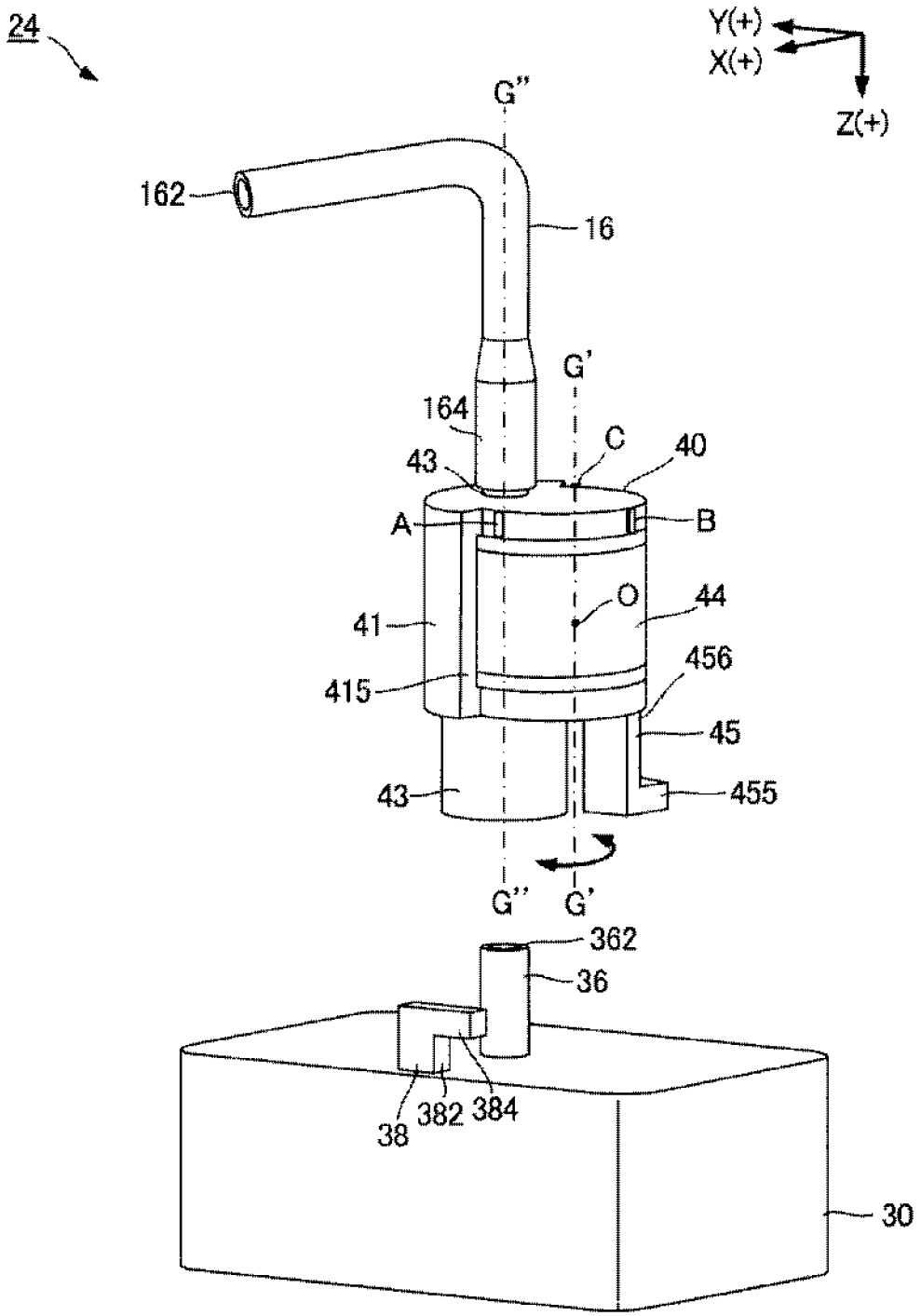
FIG. 12 is a perspective view of a flow channel system according to a third embodiment in which a liquid supply valve is detached.
Figure 13:
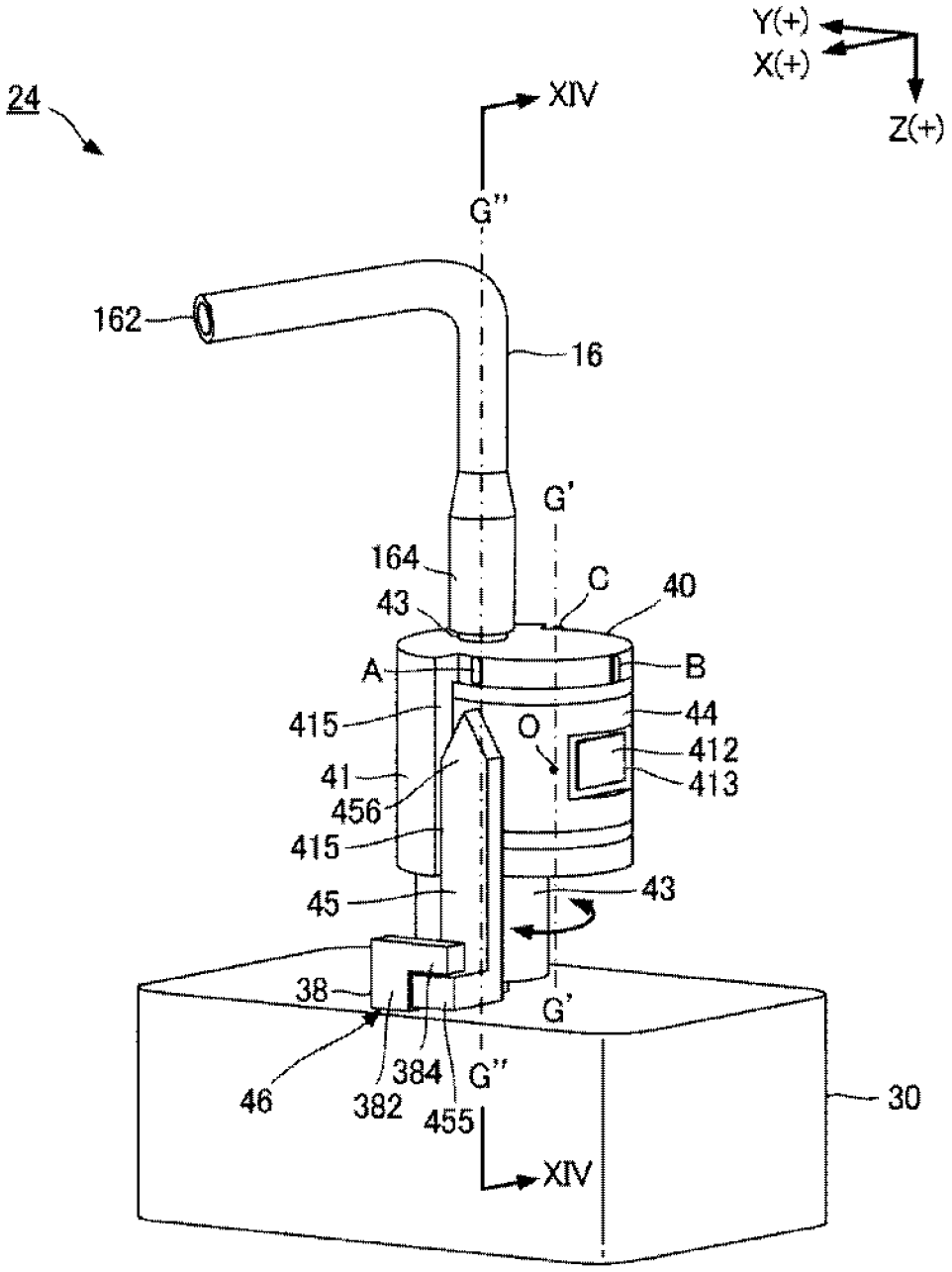
FIG. 13 is a perspective view of the flow channel system according to the third embodiment in which the liquid supply valve is attached.
Figure 14:
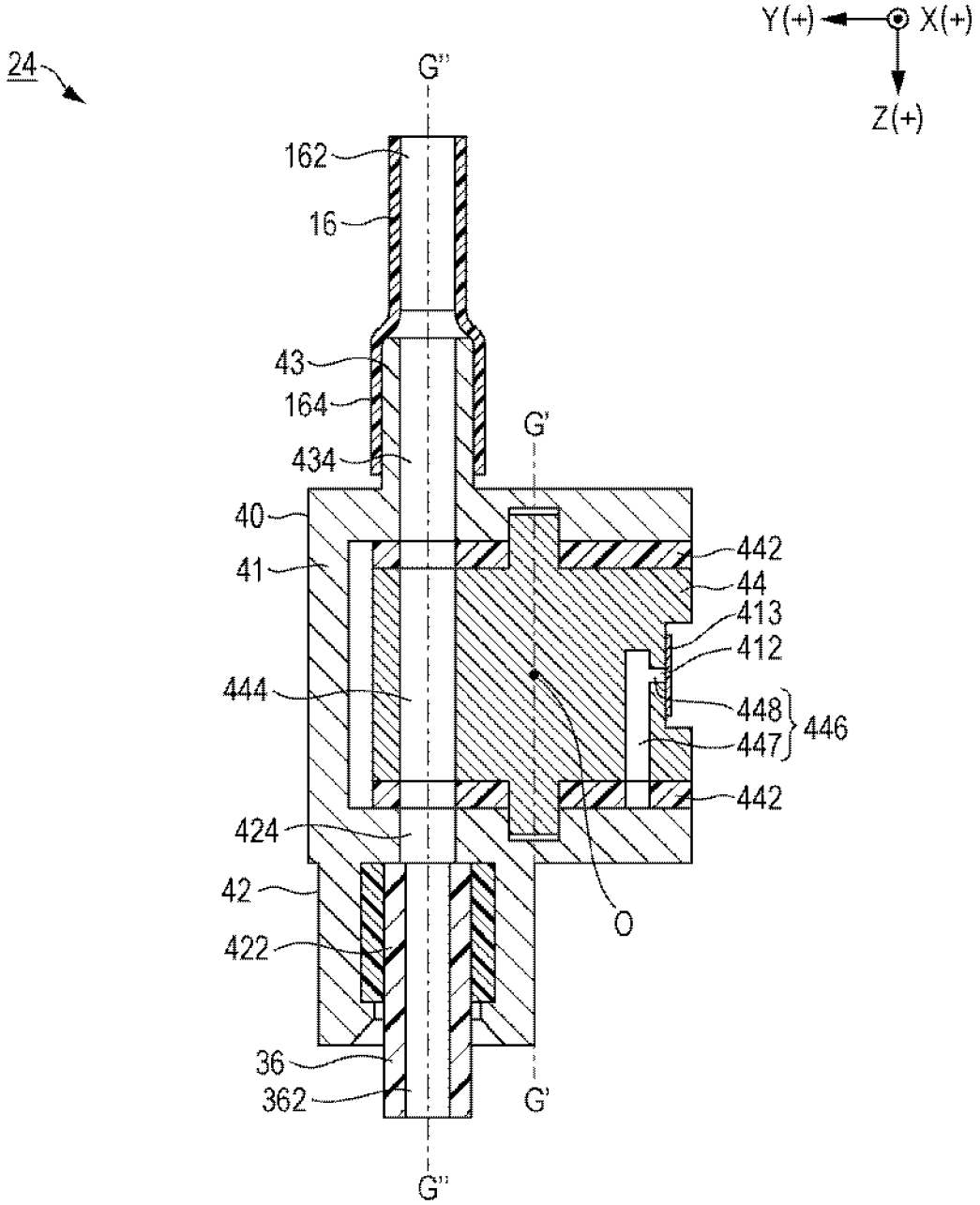
FIG. 14 is cross-sectional view along line XIV-XIV of the flow channel system of FIG. 13.

A third embodiment of the invention will be described. The valve body 44 in the liquid supply valve 40 of the second embodiment is rotated about the line G-G along an X direction, whereas a valve body 44 in a liquid supply valve 40 of the third embodiment is rotated about a line G'-G' along a Z direction. FIGS. 12 and 13 are perspective views illustrating a part of a configuration of a flow channel system 24 according to the third embodiment. FIG. 12 illustrates a case where the liquid supply valve 40 to which a liquid supply pipe 16 is fixed is detached from a liquid ejecting head 30, and FIG. 13 illustrates a case where the liquid supply valve 40 to which the liquid supply pipe 16 is fixed is attached to the liquid ejecting head 30. FIG. 14 is a cross-sectional view along line XIV-XIV of the liquid supply valve 40 of FIG. 13.

As illustrated in FIGS. 12 and 13, the liquid supply valve 40 of the third embodiment is also detachably attached to the liquid ejecting head 30 in a state where the liquid supply pipe 16 is fixed to the liquid supply valve 40 as in the first embodiment. As illustrated in FIG. 12, in the liquid supply valve 40 of the third embodiment, the cylindrical column-shaped valve body 44 is provided to be rotatable inside a substantially cylindrical valve casing 41. A part of a side surface of the valve casing 41 opens, and the valve body 44 is exposed. Therefore, inside of the valve casing 41 is opened to the atmospheric pressure in the third embodiment. The valve body 44 is rotated about the virtual line G'-G' along the Z direction which passes through the center O of the valve body 44. The line G'-G' is shifted in the X direction from a line G"-G" which is an axis of a first connection port 424 and a second connection port 434.

As illustrated in FIG. 14, two connecting flow channels (a first connecting flow channel 444 and a second connecting flow channel 446) are separately formed in the valve body 44. The first connecting flow channel 444 of the third embodiment is a connecting flow channel which makes the first connection port 424 and the second connection port 434 communicate with each other. The first connecting flow channel 444 penetrates the valve body 44 in the vertical direction (the Z direction). The second connecting flow channel 446 is a connecting flow channel which makes the first connection port 424 and an air release port 412 which opens on a side surface (a surface on the positive side of a Y direction) of the valve casing 41 communicate with each other.

The second connecting flow channel 446 is constituted by a main flow channel 447 extending in the vertical direction and a communication channel 448 communicating with the main flow channel 447. One end portion a of the main flow channel 447 (a lower end) penetrates a lower surface of the valve body 44, whereas the other end portion b on the opposite side (an upper end) does not penetrate an upper surface of the valve body 44. The communication channel 448 is perpendicular to the main flow channel 447, one end portion c (a left end) communicates with the other end portion b of the main flow channel 447, and the other end portion d on the opposite side (a right end) penetrates a side surface of the valve body 44. Therefore, in the third embodiment, the end portion d of the communication channel 448 functions as an air release port communicating with the inside of the valve casing 41. A filter 413 of the third embodiment is provided at the end portion d of the communication channel 448. In the third embodiment, a connection state between the first connection port 424 and the second connection port 434 may be switched among three states (a first state A, a second state B, and a third state C) as in the first embodiment depending on the rotational position of the valve body 44 about the line G'-G'.

Figure 15A:
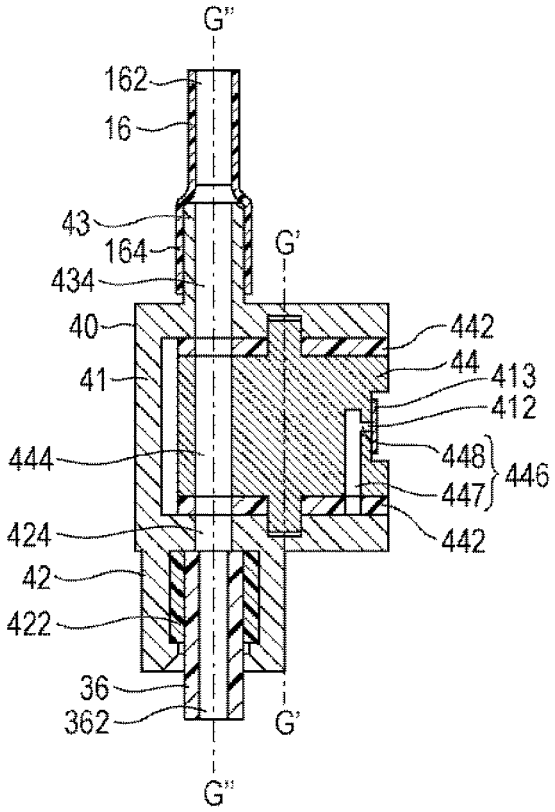
FIG. 15A is a cross-sectional view of a liquid supply valve in a first state.
Figure 15B:
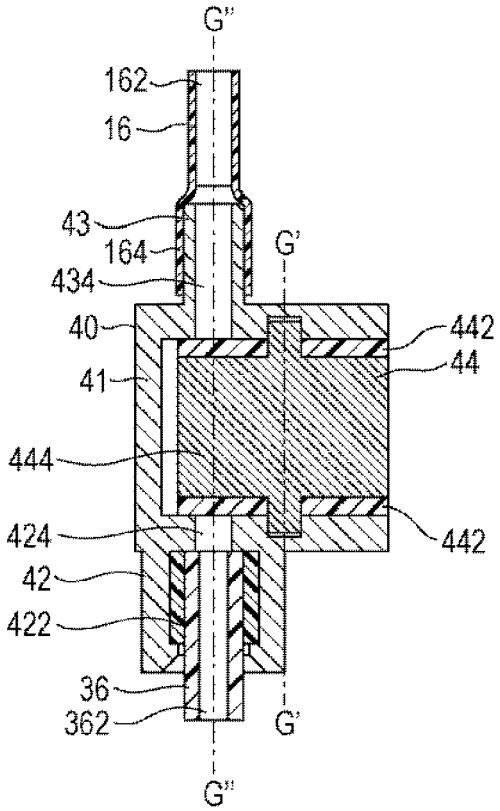
FIG. 15B is a cross-sectional view of the liquid supply valve in a second state.
Figure 15C:
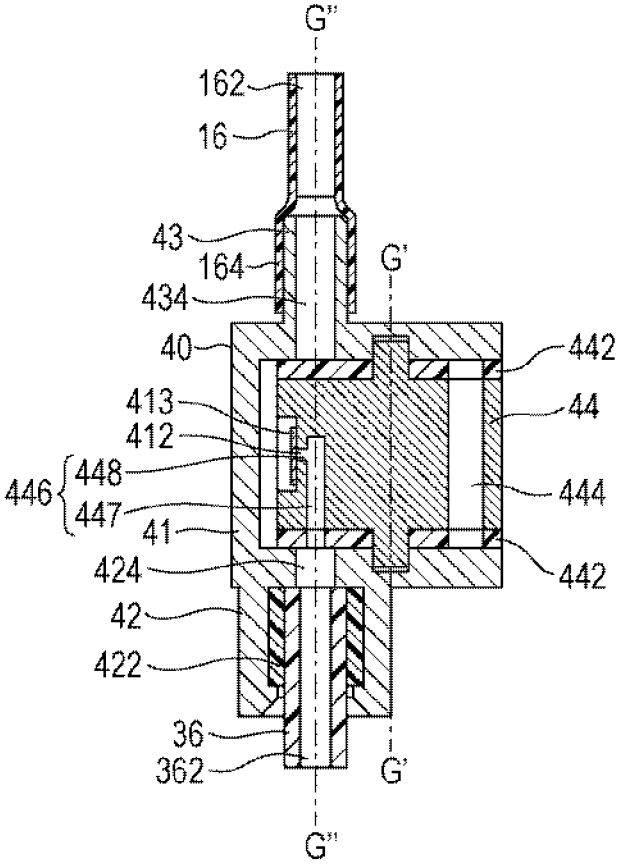
FIG. 15C is a cross-sectional view of the liquid supply valve in a third state.

FIGS. 15A to 15C are cross-sectional views illustrating the connection states at the first connection port 424 and the second connection port 434. FIG. 15A is a state where the valve body 44 is in the first state A, FIG. 15B is a state where the valve body 44 is in the second state B, and FIG. 15C is a state where the valve body 44 is in the third state C. As illustrated in FIG. 15A, in the first state A, the first connection port 424 and the second connection port 434 communicate with each other via the first connecting flow channel 444.

As illustrated in FIG. 15C, in the third state C, in a state where the second connection port 434 is disconnected, the first connection port 424 is released to air via the second connecting flow channel 446. As illustrated in FIG. 15B, in the second state B, the valve body 44 is situated at a position between the positions of the first state A and the third state C. In the second state B, the first connection port 424 and the second connection port 434 are disconnected.

As illustrated in FIG. 12, a lever 45 of the third embodiment is provided directly on an outer surface of the valve body 44 at a position where the valve body 44 is exposed from the valve casing 41. Therefore, the valve body 44 may be rotated about a line G-G with the lever 45. The lever 45 of the third embodiment is formed in the shape of an arrow, and functions also as a mark of the lever 45.

Three marks A, B, and C are formed around the line G'-G' on an outer peripheral surface of the valve casing 41 of the third embodiment. The valve body 44 may be aligned with a position of the first state A by aligning a tip of the arrow of the lever 45 with a mark A. The valve body 44 may be aligned with a position of the second state B by aligning the tip of the arrow of the lever 45 with a mark B. The valve body 44 may be aligned with a position of the third state C by aligning the tip of the arrow of the lever 45 with a mark C.

In the cylindrical valve casing 41, a wall portion 415 is formed to protrude outward from an outer periphery near the mark A. The wall portion 415, extending in the Z direction, functions as a regulating member which regulates rotation of the lever 45 and keeps the first state A of the valve body 44. When the lever 45 situated at the position illustrated in FIG. 12 is rotated clockwise when seen from above, a side surface of the lever 45 abuts the wall portion 415 and the lever 45 stops at the position of the first state A, whereby further clockwise rotation is regulated. The lever 45 may be freely moved clockwise or counterclockwise until being regulated by the wall portion 415 as the regulating member. Therefore, the positions of the valve body 44 in the three states A, B, and C may be freely adjusted until the lever 45 is regulated by the wall portion 415 as the regulating member.

A hook member 38 illustrated in FIG. 12 is constituted by an upright portion 382 which rises up from an upper surface of the liquid ejecting head 30 and a protruding portion 384 protruding from an upper end of the upright portion 382 on the negative side of the Y direction. The bent portion 455 of the lever 45 is formed to be bent outward in the radial direction of the valve body 44 at a lower end of the lever 45. When the lever 45 is rotationally moved, the bent portion 455 of the lever 45 enters a gap between the protruding portion 384 of the hook member 38 and the upper surface of the liquid ejecting head 30, and the lever 45 is fixed to the hook member 38. Therefore, a connection between a first connecting portion 42 of the valve casing 41 and a liquid introduction pipe 36 (a first flow channel 362) of the liquid ejecting head 30 is set to a locked state, and the liquid supply valve 40 is not removed from the liquid ejecting head 30. In the third embodiment, the hook member 38 is formed at a position where the connection is set to the locked state at the position of the first state A illustrated in FIG. 15A. Therefore, at positions other than that in the first state A, that is, positions in the second state B and the third state C, since the bent portion 45*c* of the lever 45 is removed from the gap between the protruding portion 384 of the hook member 38 and the upper surface of the liquid ejecting head 30, the lever 45 is set to an unlocked state.

Alternative Embodiments

Each of the above-described embodiments may be variously altered. Aspects of specific alternative embodiments will be described below. Two or more aspects arbitrarily selected from the following examples may be merged suitably in a range without contradiction.

(1) In each of the above-described embodiments, a plurality of types of liquids of different colors and qualities may be supplied to the liquid ejecting head 30. In this case, the liquid supply valve 40 may switch a plurality of states regarding a plurality of types of liquids at once. With this configuration, time and effort for the operation may be saved as compared with a case where a plurality of states of a plurality of types of liquids are switched separately.

(2) In each of the above-described embodiments, a serial head in which the carriage on which a plurality of liquid ejecting heads 30 are mounted is made to repetitively reciprocate along the X direction is described. However, the invention is applicable also to a linear head in which the liquid ejecting heads 30 are arranged over the entire width of the medium 12. A system with which the liquid ejecting head 30 ejects ink is not limited to the above-described system (a piezo system) using a piezoelectric element. For example, the invention is applicable also to a liquid ejecting head of a system using heating elements which generate air bubbles in a pressure chamber upon heating and change pressure in the pressure chamber (a thermal system).

(3) The liquid ejecting apparatus 10 described in each of the above-described embodiments is applicable to an apparatus dedicated for printing, and other various apparatuses, such as a facsimile machine and a copy machine. However, application of the liquid ejecting apparatus of the invention is not limited to printing. For example, a liquid ejecting apparatus which ejects a solution of a coloring material may be used as an apparatus for manufacturing a color filter of a liquid crystal display device. A liquid ejecting apparatus which ejects a solution of a conductive material may be used as an apparatus for manufacturing a wire and an electrode of a wiring substrate.

What is claimed is:

1. A liquid ejecting apparatus, comprising:

a liquid ejecting head;

a first flow channel in which liquid is flowed to the liquid ejecting head;

a second flow channel in which liquid is flowed from a liquid container; and a liquid supply valve in which a first connection port and a second connection port are provided, the first connection port connecting with the first flow channel, and the second connection port connecting with the second flow channel;

wherein the liquid supply valve is formed so as to be able to (i) be in a first state in which the first connection port and the second connection port communicate with each other, in a case where the liquid is supplied to the liquid ejecting head from the liquid container, (ii) be in a second state in which the first connection port and the second connection port are disconnected, in a case where the liquid supply valve attaches to the liquid ejecting head or detaches from the liquid ejecting head, and (iii) be in a third state in which the first connection port and the second connection port are disconnected, and the first connection port and an air release port communicate with each other.

2. The liquid ejecting apparatus according to claim 1, wherein the liquid supply valve includes the air release port for releasing the first connection port to air, wherein, in the first state and the second state, the first connection port and the air release port are disconnected.

3. The liquid ejecting apparatus according to claim 2, wherein the first state and the second state are switchable without entering the third state.

4. The liquid ejecting apparatus according to claim 2, wherein the liquid supply valve further includes a first connecting flow channel for connecting the first connection port and the second connection port, and a second connecting flow channel for connecting the first connection port and the air release port, and wherein, in the third state, the air release port communicates with an end portion of the second connecting flow channel on the side opposite to an end portion connected with the first connection port.

5. The liquid ejecting apparatus according to claim 4, wherein the first connecting flow channel and the air release port do not communicate with each other.

6. The liquid ejecting apparatus according to claim 2, wherein a filter is provided in the air release port.

* * * * *